US010538355B2

(12) United States Patent
Schach et al.

(10) Patent No.: US 10,538,355 B2
(45) Date of Patent: Jan. 21, 2020

(54) DEVICE FOR TREATING PACKAGES, AND PRESSURE SEGMENT FOR USE IN A DEVICE OF THIS TYPE

(75) Inventors: Martin Schach, Bochum (DE); Markus Reiniger, Monchengladbach (DE); Katrin Preckel, Gelsenkirchen (DE); Werner Van de Wynckel, Wolvertem (BE)

(73) Assignee: KHS GmbH, Dortmund (DE)

( * ) Notice: Subject to any disclaimer, the term of this patent is extended or adjusted under 35 U.S.C. 154(b) by 1627 days.

(21) Appl. No.: 14/342,478

(22) PCT Filed: Jul. 12, 2012

(86) PCT No.: PCT/EP2012/002928

§ 371 (c)(1),
(2), (4) Date: Mar. 3, 2014

(87) PCT Pub. No.: WO2013/029711

PCT Pub. Date: Mar. 7, 2013

(65) Prior Publication Data

US 2014/0223857 A1 Aug. 14, 2014

(30) Foreign Application Priority Data

| | | |
|---|---|---|
| Sep. 2, 2011 | (DE) | 10 2011 112 106 |
| Sep. 2, 2011 | (DE) | 10 2011 112 281 |
| May 21, 2012 | (DE) | 10 2012 009 873 |

(51) Int. Cl.

| | |
|---|---|
| ***B41F 17/18*** | (2006.01) |
| ***B41J 3/407*** | (2006.01) |
| ***B65B 61/00*** | (2006.01) |
| ***B41J 11/00*** | (2006.01) |
| ***B41J 2/01*** | (2006.01) |
| ***B41J 2/175*** | (2006.01) |

(52) U.S. Cl.
CPC ..... *B65B 61/00* (2013.01); *B41J 2/01* (2013.01); *B41J 2/175* (2013.01); *B41J 11/002* (2013.01)

(58) Field of Classification Search
CPC .. B65B 61/00; B65B 31/04; B41J 2/01; B41J 3/4073; B41J 17/22
See application file for complete search history.

(56) References Cited

U.S. PATENT DOCUMENTS

| | | | | |
|---|---|---|---|---|
| 4,667,804 A * | 5/1987 | Dubuit | B41F 15/0872 198/345.3 |
| 5,111,635 A * | 5/1992 | Neber | B67B 3/02 53/334 |
| 5,775,054 A * | 7/1998 | Boldrini | B65B 19/10 131/281 |
| 2003/0142168 A1* | 7/2003 | Suzuki | B41J 2/2114 347/43 |

(Continued)

FOREIGN PATENT DOCUMENTS

| | | |
|---|---|---|
| DE | 10 2007 050490 | 4/2009 |
| DE | 10 2008 012505 | 9/2009 |

(Continued)

*Primary Examiner* — Matthew G Marini
*Assistant Examiner* — Marissa Ferguson-Samreth
(74) *Attorney, Agent, or Firm* — Occhiuti & Rohlicek LLP

(57) ABSTRACT

An apparatus for treating packages by applying furnishing features to the packages includes pressure segments, each of which is configured as a fully functional assembly unit having at least one ink-jet print head. The furnishing features are polychrome printed images.

27 Claims, 17 Drawing Sheets

(56) References Cited

U.S. PATENT DOCUMENTS

| | | | | |
|---|---|---|---|---|
| 2005/0081725 | A1* | 4/2005 | Gelbart | B41F 17/22 101/36 |
| 2007/0157559 | A1* | 7/2007 | Till | B41J 2/06 53/411 |
| 2008/0083474 | A1* | 4/2008 | Mazzon | B08B 3/02 141/6 |
| 2010/0095693 | A1* | 4/2010 | Lifson | F25B 41/043 62/228.3 |
| 2011/0025738 | A1* | 2/2011 | Rosati | B41J 2/175 347/9 |
| 2011/0102504 | A1 | 5/2011 | Wanibe | |
| 2011/0179959 | A1 | 7/2011 | Gerigk et al. | |
| 2011/0232514 | A1 | 9/2011 | Putzer et al. | |
| 2012/0011807 | A1* | 1/2012 | Preckel | B41J 3/4073 53/167 |
| 2012/0255450 | A1* | 10/2012 | Till | B41J 2/16579 101/38.1 |
| 2014/0049585 | A1* | 2/2014 | Tashiro | B41J 3/4073 347/102 |

FOREIGN PATENT DOCUMENTS

| | | | | |
|---|---|---|---|---|
| DE | 10 2008 049241 | | 4/2010 | |
| DE | 10 2009 013 477 | | 9/2010 | |
| DE | 10 2009 020 702 | | 12/2010 | |
| DE | 10 2009 033 810 | | 1/2011 | |
| DE | 102009041527 | * | 2/2011 | B41J 3/4073 |
| DE | 10 2009 043 497 | | 3/2011 | |
| DE | 10 2009 058 222 | | 6/2011 | |
| DE | 10 2010 044 244 | | 3/2012 | |
| DE | 10 2011 112 106 | | 2/2013 | |
| JP | 2005-219229 | | 8/2005 | |
| JP | 2005219229 | | 8/2005 | |
| JP | 2008-126597 | | 6/2008 | |
| JP | 2008126597 | | 6/2008 | |
| JP | 2010-535112 | | 11/2010 | |
| JP | 2011-093174 | | 5/2011 | |
| JP | 2011093174 | | 5/2011 | |
| WO | 2009/112160 | | 9/2009 | |
| WO | WO2010/105726 | | 9/2010 | |

* cited by examiner b a

DEVICE FOR TREATING PACKAGES, AND PRESSURE SEGMENT FOR USE IN A DEVICE OF THIS TYPE

RELATED APPLICATIONS

This application is the national stage entry under 35 USC 371 of PCT application PCT/EP2012/002928, filed on Jul. 12, 2012, which claims the benefit of the Sep. 2, 2011 priority date of German applications DE 102011112281.1 and DE 102011112106.8, as well as the May 21, 2012 priority date of German application DE 102012009873.1. The contents of all the foregoing applications are incorporated herein by reference.

FIELD OF INVENTION

The invention to applying features to packages, and in particular, to a pressure segment used in connection with application of such features.

BACKGROUND

Devices for treating packages are known in different embodiments. Among others, DE 10-2009-043-497 shows a device in which the packages are each held on one and the same holding-and-centering unit, or puck, during the entire transport from a package inlet to a package outlet, and the holding-and-centering units only release the packages at the package outlet from which the holding-and-centering units are then returned to the package inlet on a puck return transport section.

Printing systems for printing containers with the use of digital, electrical print heads that operate on the inkjet principle are known to the skilled person. In particular, printing systems or printing machines are also known in which a plurality of treating or printing positions, each for receiving a container that is to be printed, are formed on a transport element driven to rotate about at least one vertical axis, and on which the containers are printed using electronically triggered digital print heads that operate on the inkjet principle.

SUMMARY

The object of the invention is to further develop a device for applying furnishings that adapts in a trouble-free way to packages of different type, size, and form with high operational reliability possible, or that can be assembled with little effort in a compact design with high operational reliability.

In further development of the invention, the device is configured, for example, in such a way that a carriage on which at least one print head is disposed and that is height-adjustable, i.e. adjustable in the direction of the machine axis, and that can be tilted to the machine axis is provided in the pressure segment at each of the treatment positions and/or that a plurality of secondary parts adapted to different types, forms and/or sizes of packages are associated with the primary parts of the holding and centering units, which are preferably configured as pucks, and/or that the holding and centering units, preferably their secondary parts, are configured with an RFID tag, and/or that a puck transport section for returning the holding and centering units configured as a puck is configured, at least from the package outlet to the package inlet, in part by those transport-and-treatment elements that are also part of the packages transport section, and/or that positions or mountings to receive the holding and centering units configured as a puck are formed between the treatment positions, and that these mountings are part of the puck transport section, and/or that the holding and centering elements each exhibit at least one holding and centering unit for the passive holding of the packages, for example for holding the packages by spring force, and/or that the holding and centering units are configured for covering the packages in the region of a packages mouth and/or in the region of a thread provided there for a screw cap, for example in the form of a recess to receive the mouth region of the respective packages, and/or that the holding and centering units are held passively at the associated pressure segment, i.e. the required holding force is applied to the primary part passively, and that the holding and centering units are actively removed from the pressure segments, whereby the aforementioned features may be provided individually or in any desired combination.

As used herein, the term "packages" includes packaging elements or containers usually used in the food industry and specifically also in the drinks sector, including in particular containers such as for example bottles, cans, also soft packaging, for example those produced from cardboard and/or plastic film and/or metal film.

As used herein, the term "puck" is to be understood to be a holding, centering, and aligning part for the packages on which the respective packages are moved from a package inlet to a package outlet through a package transport section of the transport system and that preferably also provides a controlled orientation of the respective packages for the latter's treatment.

As used herein, the expression "transport elements adjacent to one another for transport purposes" means transport elements or transport-and-treatment elements that are configured and arranged in such a way that, at transfer regions, they receive the pucks from an adjacent transport element that is ahead in a transport direction, hold them, and pass them to a transport element that is behind in a transport direction.

As used herein, the expressions "essentially," "in essence," or "around" mean variations from the respective exact value by +/−10%, preferably by +/−5% and/or variations in the form of changes insignificant for the function.

Further embodiments, advantages and possible applications of the invention arise out of the following description of embodiments and out of the figures. All of the described and/or pictorially represented attributes, whether alone or in any combination, are fundamentally the subject matter of the invention independently of their synopsis in the claims or a retroactive application thereof. The content of the claims is also made an integral part of the description.

It is an advantage if use is made of holding-and-centering units having a secondary part in which the package, the bottle, or the container is held, that is mounted on or in a primary part, that can be rotated and driven about a vertical axis, and that can also be driven by a motor. In one embodiment, there can be provision for the secondary part to form the rotor of an electromagnetic direct drive, and for the controlled aligning and/or rotating of the respective packages to be effected in this way. For this, the secondary part will preferably be provided with a permanent magnet array that interacts with a stator of the electromagnetic direct rotary drive or with a solenoid array that forms this stator.

Alternatively, the secondary part may also comprise an infinitely controllable electric motor, in particular a servomotor, or it may consist of such a motor in a main component. In this case the primary part in a main component comprises the motor housing or consists essentially of the motor housing of an infinitely controllable motor.

Because the angular position of the rotor or packages is variable, at least one coding for the rotational angle position is ideally provided on the secondary part, and if necessary also on the primary part. The coding interacts with a suitable sensor or reading unit, in particular one or a plurality of incremental sensors at the respective working position. Moreover, alternatively or additionally, the primary part can always be uniquely defined or definably executed in its rotational angle position relative to the respective treatment positions by a form-fitting mounting, centering unit or a coupling element provided such that only the relative rotational angle position of the secondary part to the primary part must be configured to be detectable by a sensor, reading unit etc. The position relative to the pressure segment or print head can then be derived from this.

During the printing of empty packages, especially PET, PEN, PE or PP empty bottles, which represents the normal case, the packages should preferably be under a slight positive pressure. For this purpose, on the holding-and-centering unit, there is provided a locking piece for a coupling element on the machine or pressure segment that is configured as a quick-acting coupling. With this, a vaporous or gaseous medium, e.g. compressed air, can be fed into the packages through an inner line, in this case the hollow interior space of the puck. The lower outlet of this inner line forms a central centering element/taper. For this, at least one transport-and-treatment unit, ideally the first, is connected to a vapor or gas source or comprises a suitable compressor.

The locking element of the coupling is advantageously configured as a non-return valve. In the alternative, a non-return valve is provided in the inner line. After the preloading with a vaporous and/or gaseous medium, e.g. compressed air, this pressure can be maintained in the packages over the entire package transport section or printing section in this way.

BRIEF DESCRIPTION OF THE DRAWINGS

The invention is explained in detail below through the use of embodiment examples with reference to the figures. In the figures.

DETAILED DESCRIPTION

Figure 1:
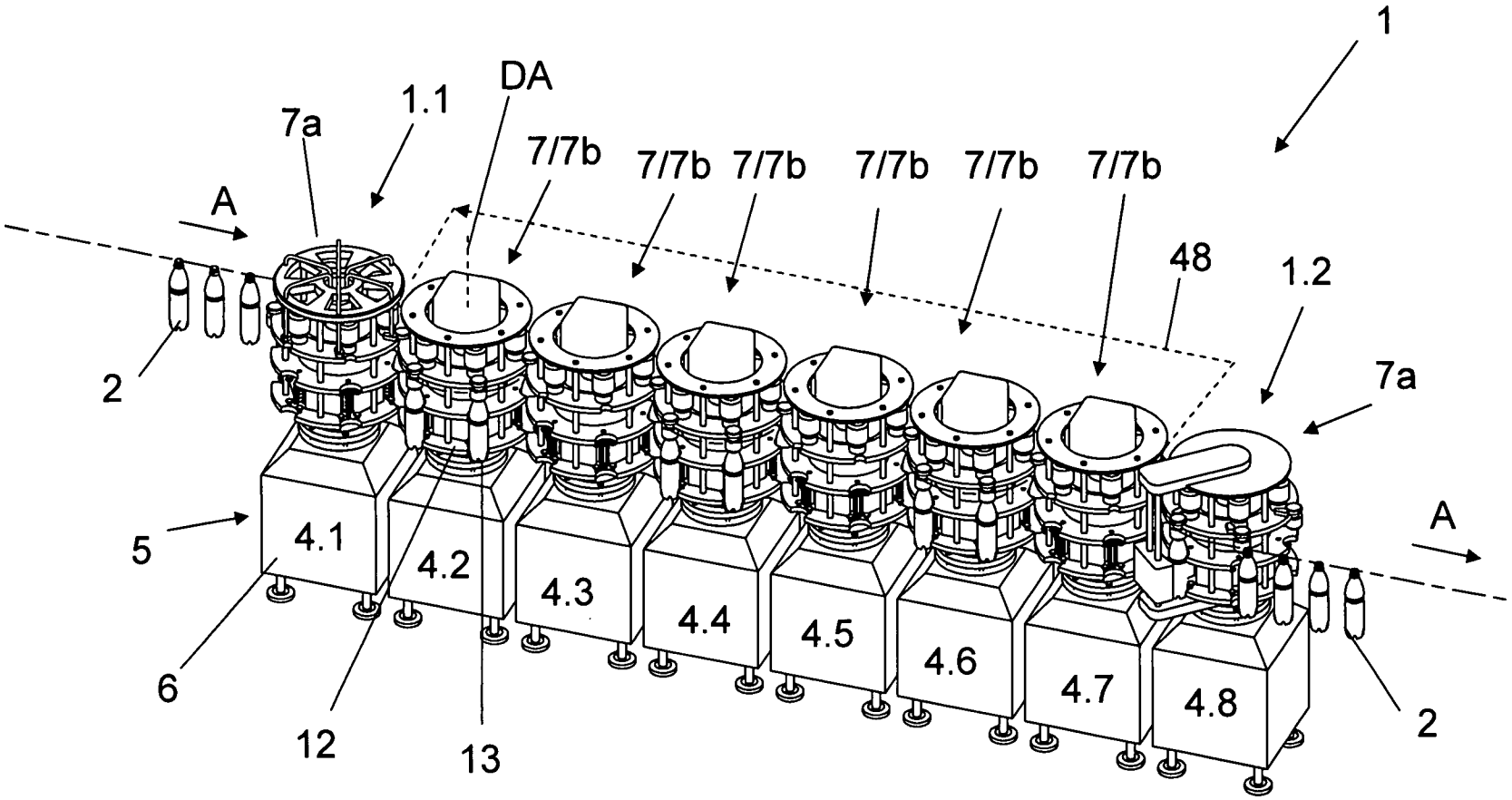
FIG. 1 shows, in simplified schematic and perspective representation, a device or installation for the treatment of packages by applying to the packages a furnishing in the form of a multiple print.

FIG. 1 shows a device 1 used to apply a furnishing, for example in the form of an imprint or multiple-pass print, to a package 2, such as a bottle, and to do so either directly to the exterior or envelope surface of the package 2 or to labels, e.g. provided with partial furnishing, already affixed thereto.

For printing, packages 2 are fed standing upright to the device 1 or its package inlet by an external transporter in a transport direction A. The packages then move within the device 1 on a transport section 3 having multiple arcuate deviations. After printing, packages 2 are fed, still standing upright, by an outer transporter to a subsequent use at a package outlet 1.2. The transport section 3 of the packages 2, when feeding, when moving through device 1, and when exiting device 1 is represented schematically in FIG. 2.

In detail, device 1 comprises a plurality of modules **4.1-4.*n* arranged immediately contiguously in the transport direction A. In the depicted embodiment, there are eight modules 4.1-4.8, each being formed of an identical base unit 5 that is equipped with the functional elements necessary for the special task of respective modules 4.1-4.8**.

Each base unit 5 comprises a drive and control unit accommodated in a module housing 6 and a transport-and-treatment element 7, **7*a* that is arranged on the top of module housing 6 and that can be driven by the drive-and-control to rotate about a vertical machine axis of a respective module 4.1-4.8, and that has a plurality of mountings or treatment positions 8 that are provided distributed at equal angular distances about the periphery of transport-and-treatment element 7 or 7*a*, and of which each mounting or treatment position 8 is configured to reliably pick up one packages 2**.

Figures 2, 3:
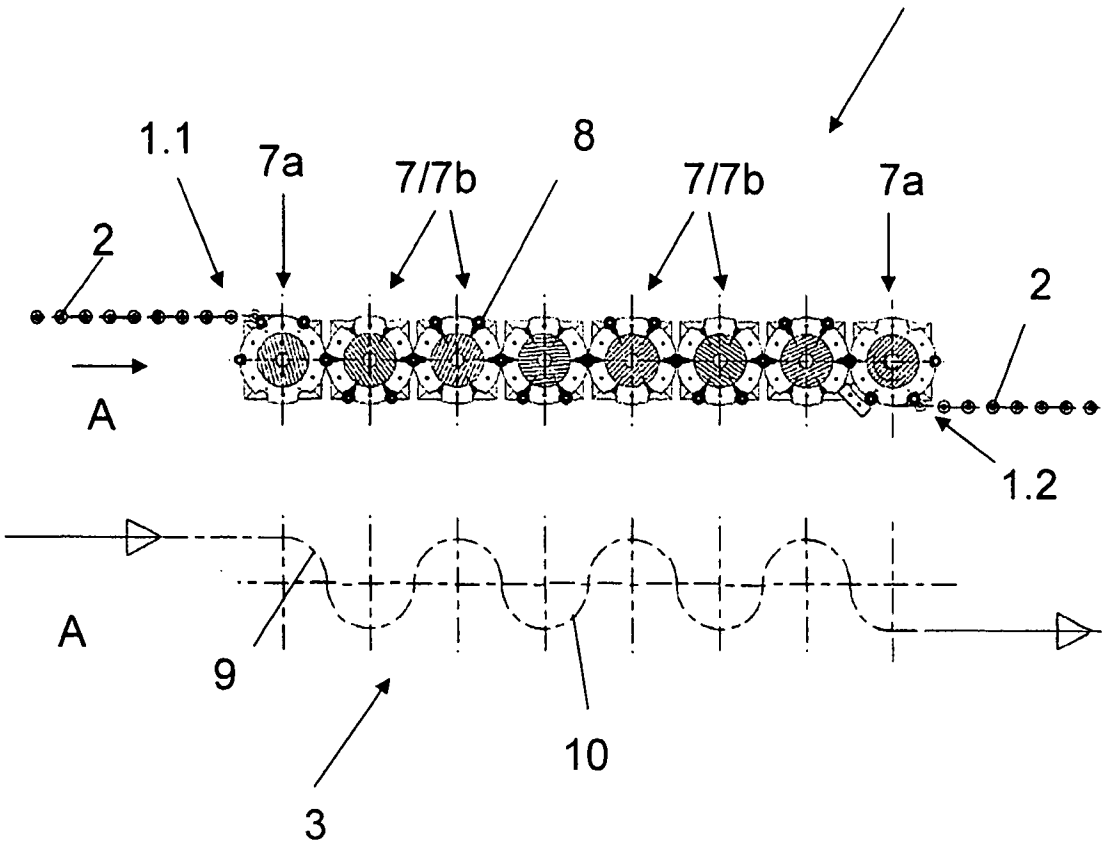
FIG. 2 shows, in simplified schematic representation, the device or installation for treatment packages in plan view.
FIG. 3 depicts a schematic representation and plan view of the transport or conveyor path of the packages through the device shown in FIGS. 1 and 2.

For transport purposes, transport-and-treatment elements 7, **7*a* of individual modules 4.1-4.8 are arranged immediately adjacent to one another, and driven in counter-rotation but synchronously such that these transport-and-treatment elements 7, 7*a*, in their totality, form a transport device by which packages 2 are moved within the device 1 on the multiply deviated package transport section 3 shown in FIG. 3 between package inlet 1.1 and package outlet 1.2. Individual packages 2 are each transferred directly from transport-and-treatment element 7 of one module 4.1-4.7 to transport-and-treatment element 7 of another module 4.2-4.8** that follows in the transport direction A.

In the representation in FIGS. 1 and 2, transport-and-treatment element 7 of module 4.1 which is the first relative to transport direction A is driven synchronously clockwise, transport-and-treatment element 7 of the next-following module 4.2 counterclockwise, transport-and-treatment element of the next-following module 4.3 again clockwise and so forth. The synchronization of the individual modules 4.1-4.8 is effected by a suitable controller.

In the embodiment shown in the figures, individual modules 4.1-4.8 are again provided sequentially such that the vertical machine axes of all modules 4.1-4.8 lie in a common vertical plane in which are also located the transfer regions where packages 2 are transferred from transport-and-treatment element 7*a* or 7 of one module 4.1-4.7 to transport-and-treatment element 7 or 7*a* respectively of module 4.2-4.8, which follows in transport direction A.

The basic and also known function of individual modules 4.1-4.8 is, for example, as follows:

Module 4.1 constitutes an inlet module or package inlet 1.1 of the device 1. In module 4.1, a pretreatment is also preferably carried out on packages 2, at least in the region of the packages that is to be printed. An example would be a plasma or corona treatment, which is practicable particularly if the application of the multiple-pass print in the subsequent modules is effected with the use of print stations or print heads in those modules that operate according to the known inkjet print head principle or so-called Tonejet principle. The pressurizing of the packages (2) is also advantageously effected in module 4.1.

Modules 4.2-4.5 following module 4.1 constitute the actual print modules in which the multiple-pass print is effected, preferentially as a colored print in which one of each of the four primary colors (yellow, magenta, cyan, and black) is printed at each of the modules 4.2-4.5.

Module 4.6, which then follows in the transport direction A, is configured as a drying module in which the respective previously generated multiple-pass print is finally dried in a suitable manner, for example by the application of energy e.g. by heat and/or by UV radiation.

Module 4.7 is configured as an inspection module through which each package 2 passes after the drying of the multiple-pass print and in which the multiple-pass print concerned is examined for possible errors so that incorrectly printed packages 2 can be separated out at module 4.7 or subsequently on the onward transport section.

Finally, module 4.8 is outlet module or package outlet 1.1 of the device 1 at which the fully printed packages 2 leave the device 1. Module 4.8 is preferentially also configured as a drying module.

As seen in FIG. 3, packages 2 are each moved with transport-and-treatment elements 7 of modules 4.1 and 4.8 over an angular range of approximately 90° about vertical machine axes MA of modules 4.1 and 4.8. In the case of the other modules 4.2-4.7, packages 2 are each entrained by respective transport-and-treatment element 7 over an angular range of 180° about the vertical machine axes of modules 4.2-4.7. The process that is assigned to the respective module is carried out, in particular in modules 4.2-4.7, within this angular range or within this path of the rotational motion of respective transport-and-treatment element 7.

In greater detail, modules 4.1-4.*n*, but at least modules 4.2-4.7, which are used for the printing of packages 2, or circulating transport-and-treatment element 7 of said modules, comprises a plurality of pressure segments 11 that are each mounted interchangeably as complete functional assembly units on a rotor 12 driven to rotate about a respective vertical machine axis MA. The rotor is mounted rotatably about vertical machine axis MA on a respective module housing 6 or on a central pillar 13. Pressure segments 11 which are provided on the periphery of rotor 12, are adjacent to one another in peripheral direction of rotor 12 and are configured as wedges when seen in plan view. Each pressure segment 11 encloses a space in which are accommodated a plurality of functional elements, such as electronic control elements or computers 14 (FIG. 12) for triggering pressure segments 11.

Figure 4:
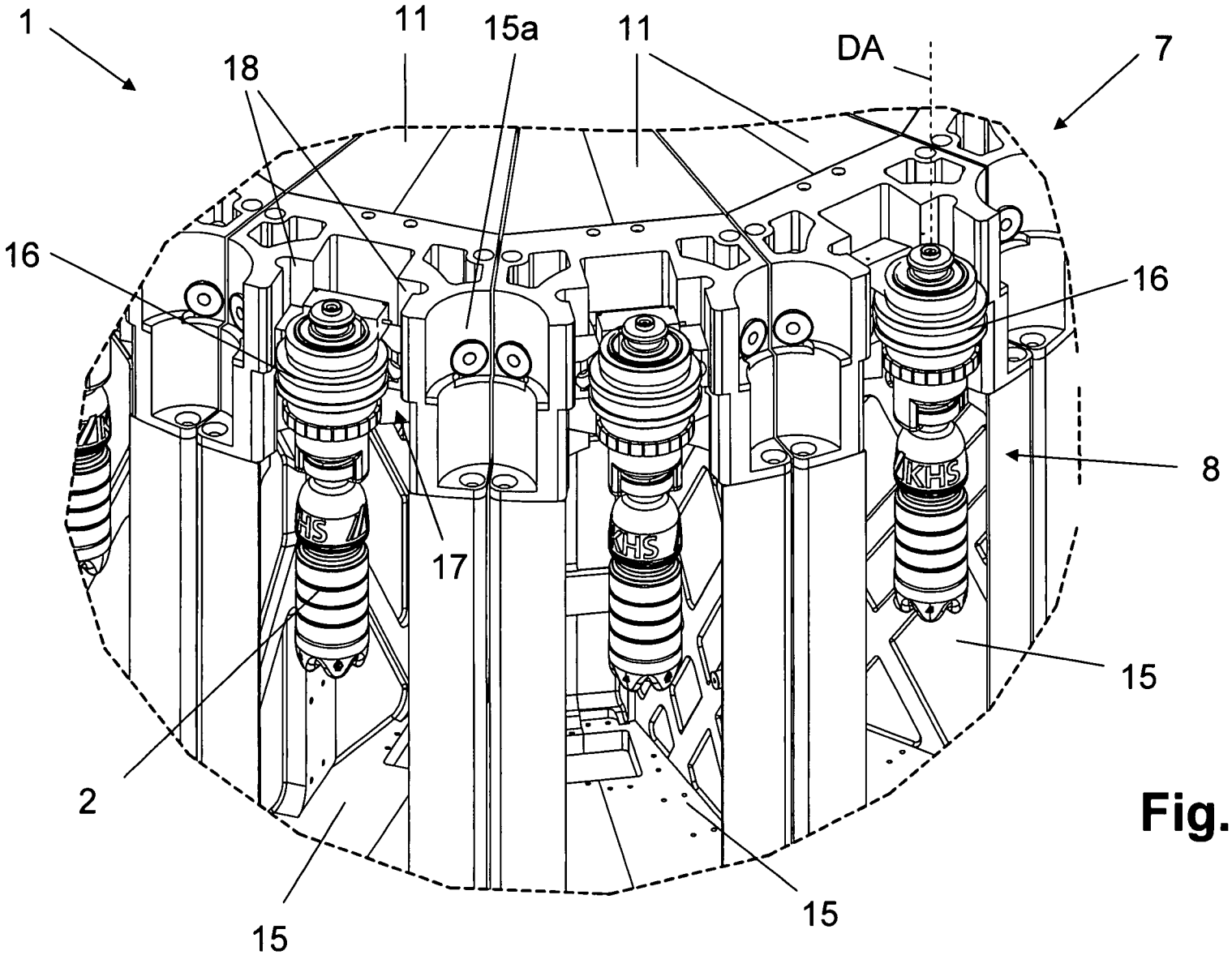
FIG. 4 shows, in a perspective partial view, one of the transport-and-treatment elements, consisting of a plurality of pressure segments.
Figure 5:
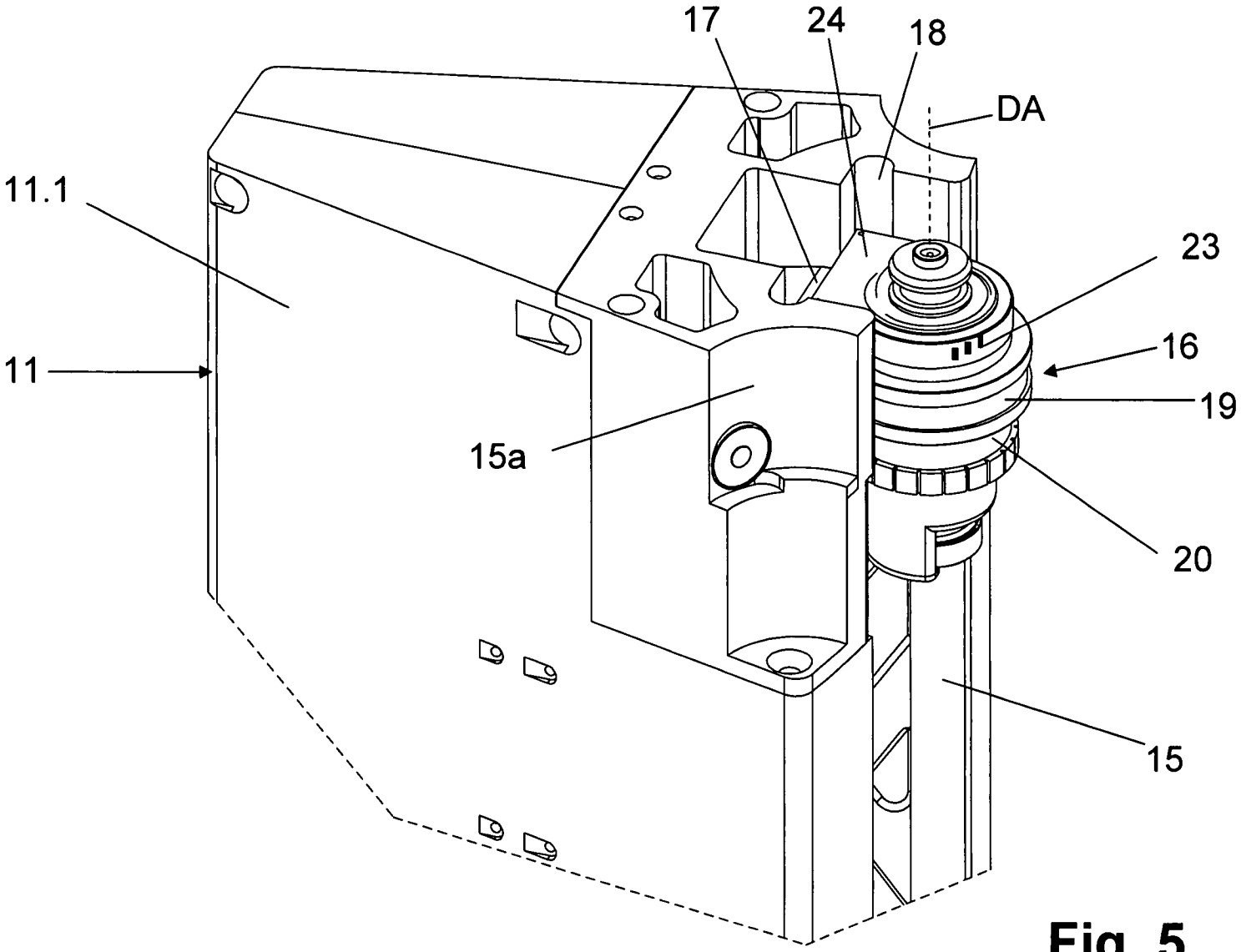
FIG. 5 shows, in perspective, a pressure segment of the transport-and-treatment element of FIG. 4.
Figure 7:
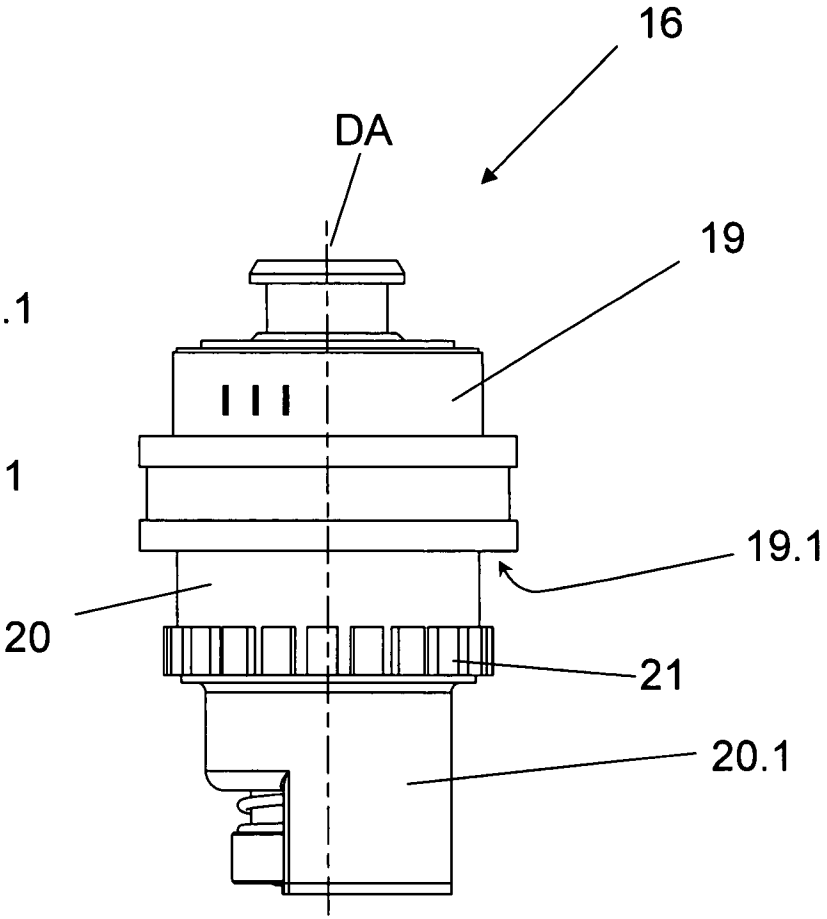
FIGS. 6-8 show several perspective views of a holding-and-centering unit of the device of FIG. 1, together with a package configured as a bottle.
Figure 6:
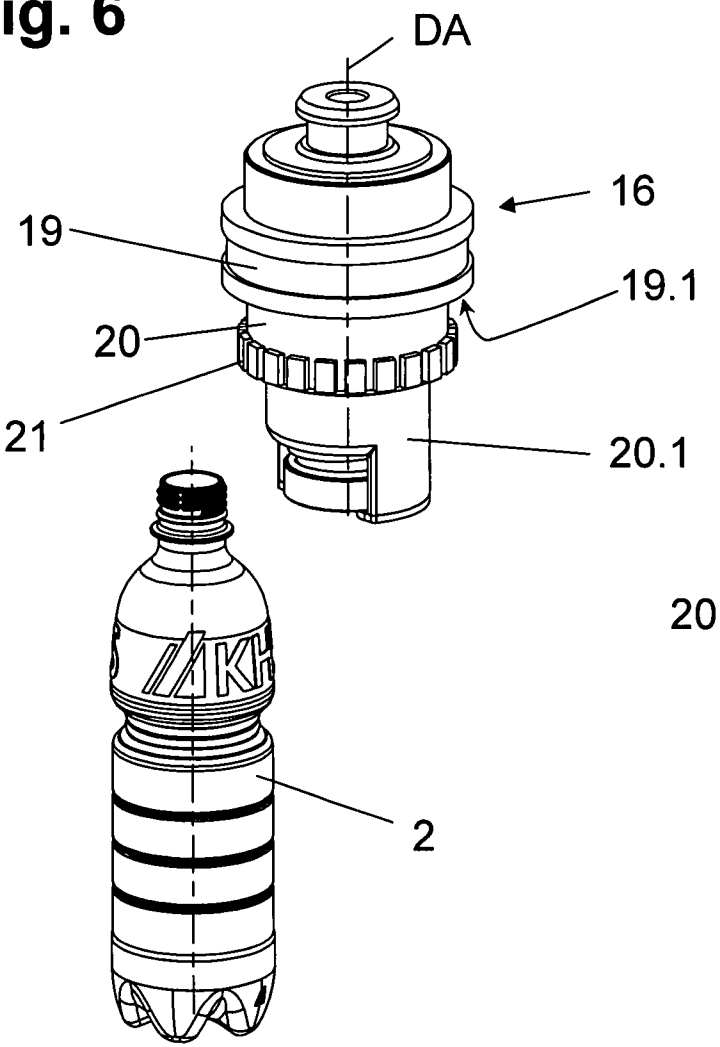

On their side which is radially outward relative to machine axis MA, each pressure segment 11 forms a recess 15, shown in FIG. 4 and FIG. 5, in which, during treatment, packages 2 are received at least by a part of their packages body, while suspended from holding-and-centering units 16 in the region of their package top or package opening, i.e. with the packages oriented vertically and parallel to the machine axis MA and to a pressure segment axis DA. In the region of mounting or recess 15, each pressure segment 11 has at least one print head and any other functional elements required to print on a package 2.

Figure 13:
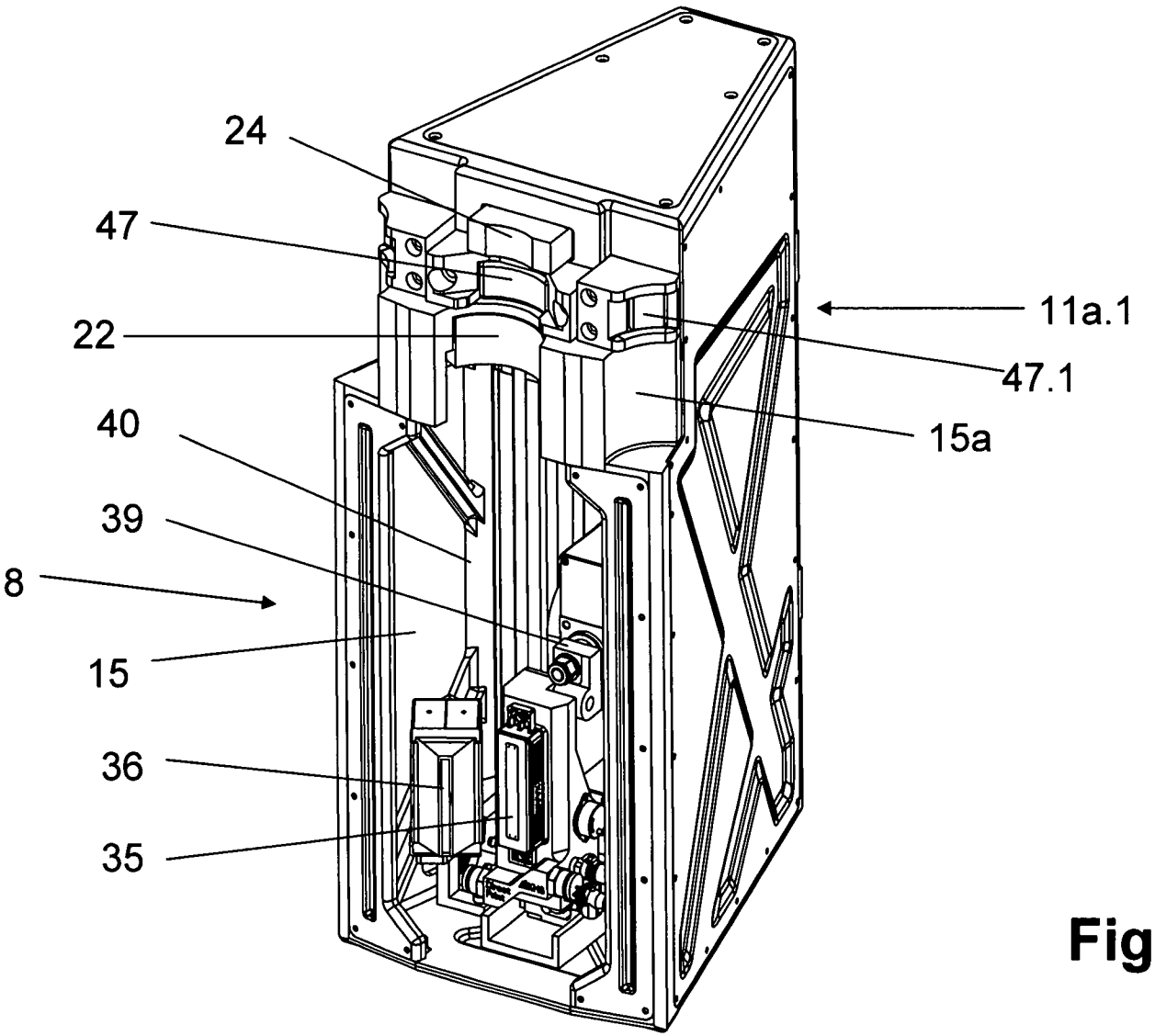
FIGS. 13 and 14 show different views of a pressure segment of the transport-and-treatment element of FIG. 12.
Figure 14:
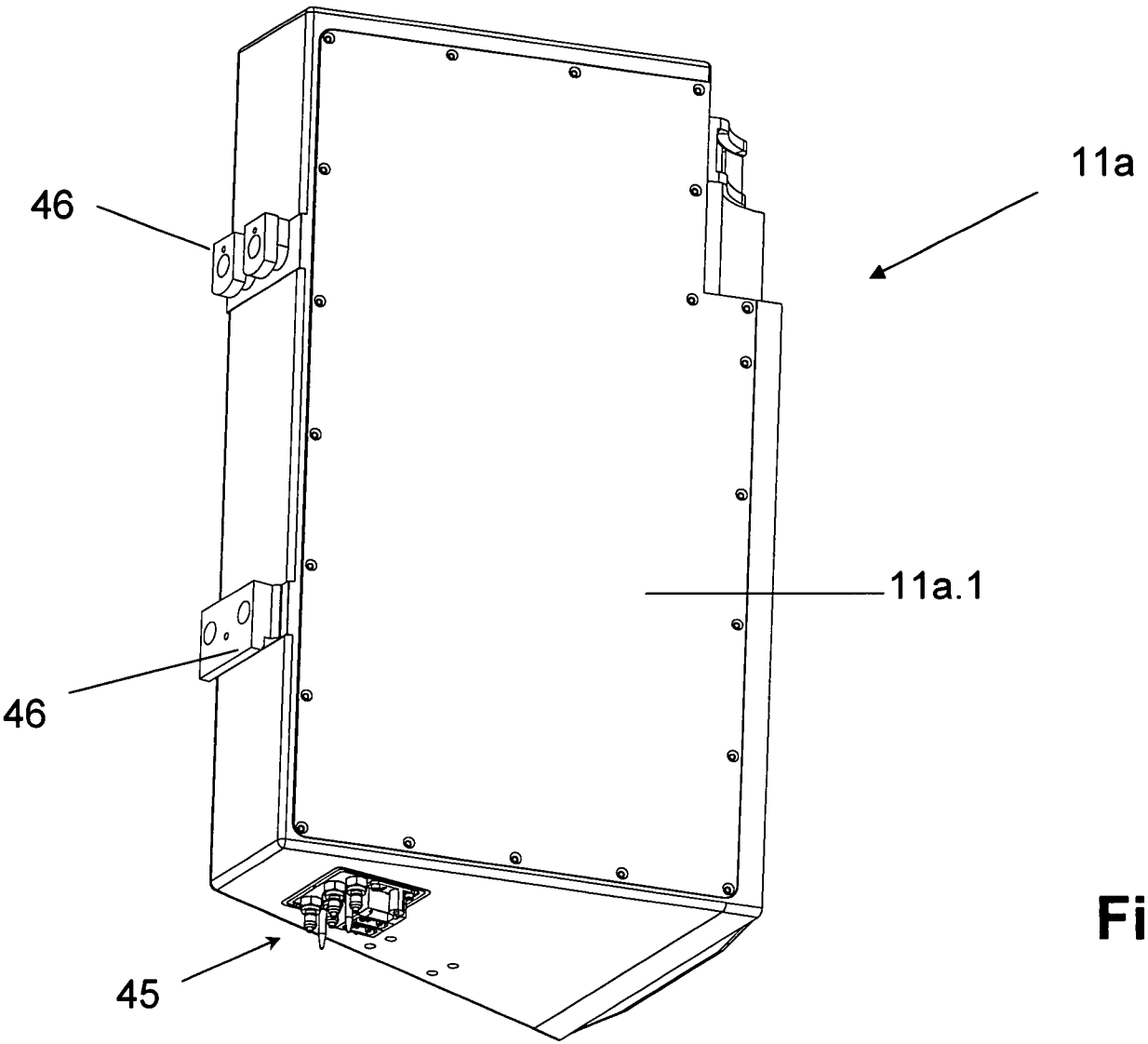
Figure 15:
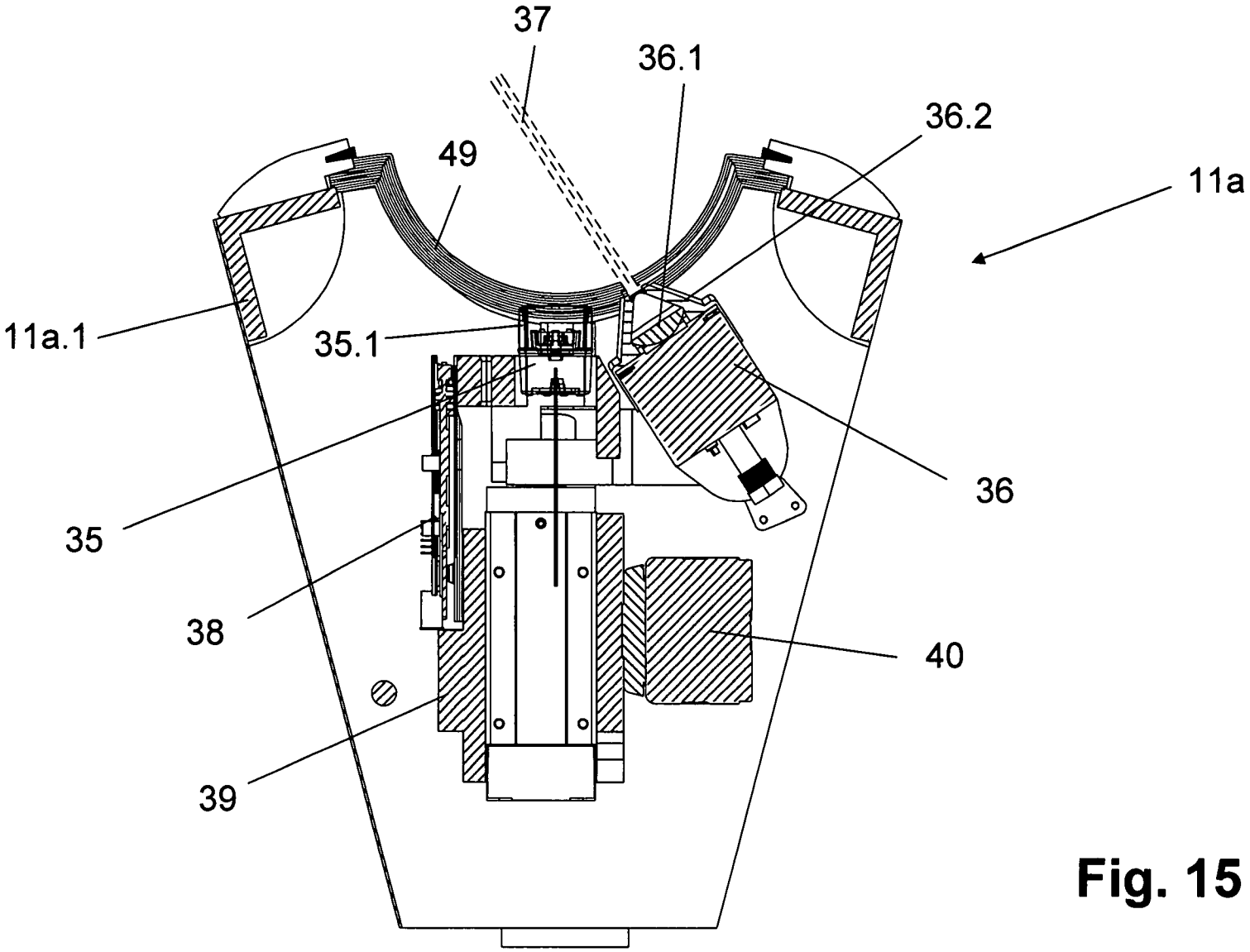
FIG. 15 shows a simplified horizontal section through the pressure segment of FIGS. 13 and 14.
Figure 16:
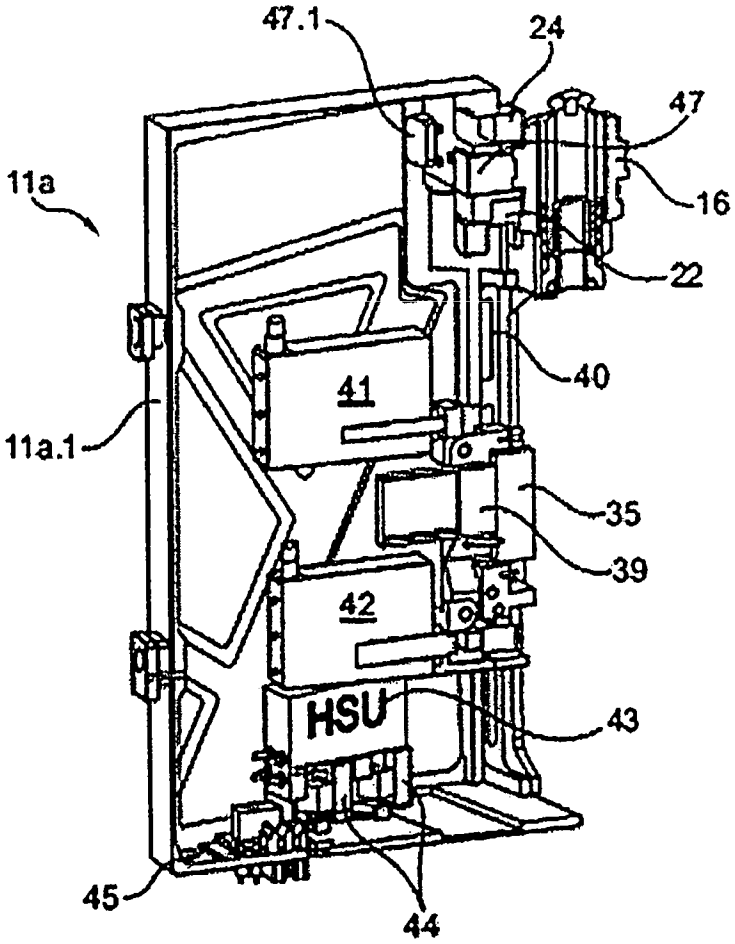
FIG. 16 shows a simplified vertical section through the pressure segment of FIGS. 13 and 14.

Holding-and-centering units 16 are in turn each held on a carrier 17 that is fastened in associated lateral slots 18. Optionally, the carrier 17 can be traversed or displaced like a carriage in slots 18, or driven by a motor if applicable (FIG. 5). In case of the alternative depicted in FIG. 13, the carrier 17 is not configured in that form, but all elements or functions are directly integrated into the pressure segment 11, 11*a*. Holding-and-centering units 16 that, during the treatment and/or printing of packages 2 effect an aligning and controlled rotation and/or pivoting of packages 2 about their vertical axis, which is disposed on the same axis as the pressure segment axis DA, consist essentially, in the depicted embodiment, of a primary part 19, which is held on respective carrier 17, and of a secondary part 20. The primary part 19 essentially serves to align and fasten the holding-and-centering unit 16 on the carrier 17, on the treatment position 8, or on the pressure segment 11. For this purpose, the primary part 19 has a reference face 19.1 whose complementary counterpart in the pressure segment 11 serves as a reference plane or reference face for locating and hence for adjustment relative to the print head. A fixed common reference between holding and centering unit 16 or packages 2 and the respective print head or print heads is created in this way.

The function of secondary part 20 includes suspending respective packages 2. The secondary part 20 is configured like a gripper, for example as a mechanical and/or pneumatically actuated gripper and/or as a vacuum gripper. In respective pressure segment 11, the required holding force is ideally passively applied to primary part 19 and actively removed or released, for example by way of one or a plurality of permanent magnets, so as to increase safety in the absence of flow or media.

The secondary part 20 comprises the active components, i.e. all components needed for the aligning and controlled rotating or pivoting of packages 2 during treatment, such as elements required for aligning and/or rotating the packages during printing, and/or elements for supplying compressed air and/or vacuum etc.

Thus, secondary part 20, which is mounted in the primary part 19 so as to be able to rotate or pivot about the pressure segment axis DA, constitutes, in the depicted embodiment, the rotor of an electric positioning or angular drive for the aligning and controlled rotating or pivoting of packages 2 during treatment. The secondary part 20 is provided for this purpose with among, other things, a permanent magnet array 21 that exhibits a plurality of permanent magnets. Permanent magnet array 21, which in a peripheral direction exhibits alternately north and south poles, interacts with a solenoid array 22 that is provided on carrier 17 and that forms the stator of the positioning drive or electromagnetic direct drive.

On the primary part 19, there is provided a coding 23 that, in interaction with an incremental sensor 24 provided on the carrier 17, constitutes an encoder system that determines the respective random orientation of the primary part 19 and hence of the holding-and-centering unit 16. The aligning and controlled rotating of packages 2 during printing is then effected taking account of this orientation as determined by the encoder system and taking account of the association, known from the design or defined, between the primary part 19 and the rotational position of the secondary part 20, and solely by rotating the secondary part 20 while the primary part 19 does not rotate. Incremental sensor 24 is static relative to rotor 12 or pillar 13 and rotates with these. The aligning and controlled rotating of packages 2 about the pressure segment axis DA is effected relative to respective pressure segment 11 or relative to functional elements located there, in particular print heads, which are used for the treatment.

Figure 9:
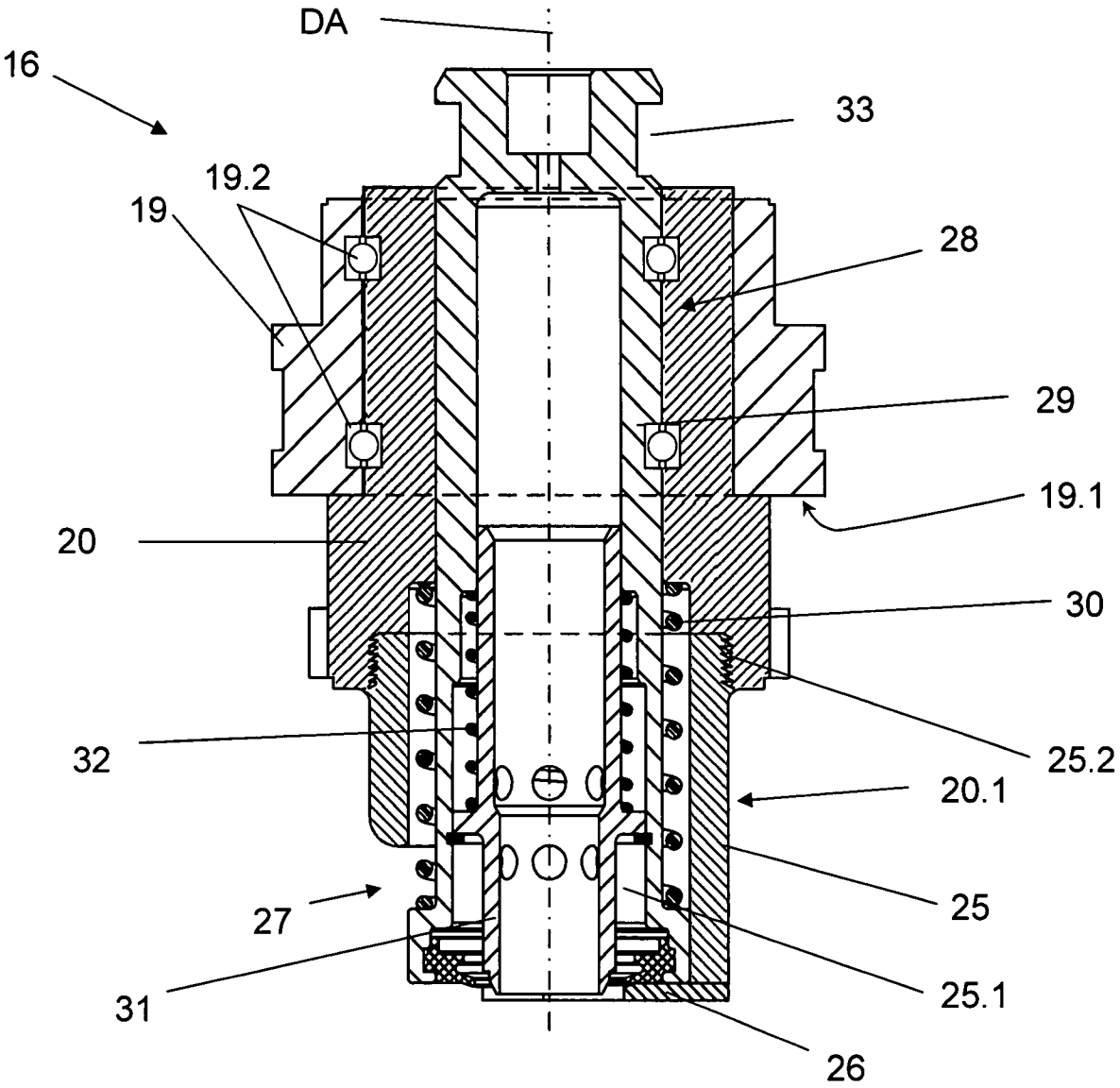
FIG. 9 shows a section through a holding-and-centering unit of the device of FIG. 1.

FIG. 9 shows an embodiment of a holding-and-centering unit 16 in section and in idle position without packages. As depicted, the holding-and-centering unit 16 has an essentially ring-like primary part 19 and an essentially sleeve-like secondary part 20 that is mounted in the primary part 19 so as to be able to rotate about the pressure segment axis DA and that projects with its lower length beyond the underside of primary part 19, where it is configured with a receiving and base part 20.1. Bearings 19.2 are only sketched here. A bearing sleeve, needle bearing, or an equivalent structure may also be provided. This is adapted to the type, shape, and size etc. of packages 2 and is part of a gripper for the holding of the still-empty packages 2. Specifically, receiving and base part 20.1 is constituted by a sleeve 25 arranged with its axis on the same axis as the pressure segment axis DA, and a carrier plate 26 at the lower open end of sleeve 25. Base part 20.1 can be separated from the upper section of the sleeve 25 by a thread 25.2. A bayonet closure, clamp, or other mechanism could also be selected as an alternative to the thread 25.2. Sleeve 25 is laterally open at an opening 27 so that according to position (a) in FIG. 10, the respective bottle constituting packages 2 are introduced through opening 27 into receiving and base part 20.1 (arrow B) and then according to position (b) in FIG. 10 can be fixed to receiving and base part 20.1, and in such a way that packages 2 are held on carrier plate 26 suspended by a mouth edge 2.1.

In the secondary part 20, a centering-and-holding element 28 is arranged to be axially displaceable relative to the pressure segment axis DA. In the illustrated embodiment, centering-and-holding element 28 has an outer sleeve body 29 that is preloaded by way of a compression spring 30 in a lower position in that lies with its lower end face against the carrier plate 26 and, in the case of packages 2 in the form of a bottle held at holding-and-centering unit 16, against the upper side of a package 2 that faces away from carrier plate 26 or against the mouth edge 2.2 of packages 2 there located, such that the latter is clamped firmly, and in particular so that it cannot rotate, by the force of the compression spring 30 between sleeve body 29 and carrier plate 26. A centering sleeve 31 that is also arranged on the pressure segment axis DA is provided in the sleeve body 29 so as to be axially displaceable. The centering sleeve 31 is also preloaded by a compression spring 32 in a lower position.

In order to receive a packages 2 or bottle, the centering-and-holding element 28, which includes a sleeve body 29, a first compression spring 30, a centering sleeve 31, and a second compression spring 32, is raised against the action of the first compression spring 30 (step 1) by a lifting element that engages behind a collar or an annular slot 33 of the sleeve body 29 and that is provided at least on package inlet 1.1 and package outlet 1.2, as was shown in FIG. 10*a*.

After the introduction of the packages into holding-and-centering unit 16 (FIG. 10*b*), the centering-and-holding element 28 is lowered by the action of compression springs 30, 32 and thereby centered and positioned in the receiving and base part 20.1 (step 2) and subsequently fastened passively, i.e. by clamping (step 3).

Figure 10:
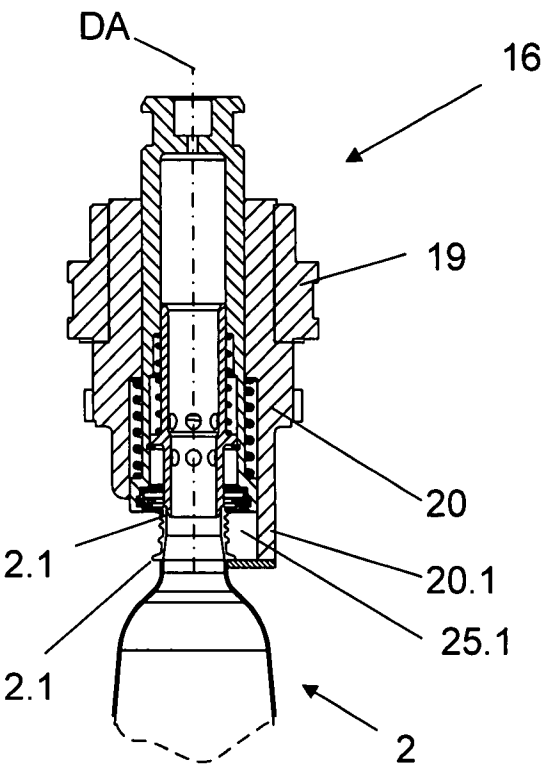
FIG. 10 shows, in positions (a) and (b), the holding-and-centering unit in section together with a package configured as a bottle in different operating statuses.
Figure 10:
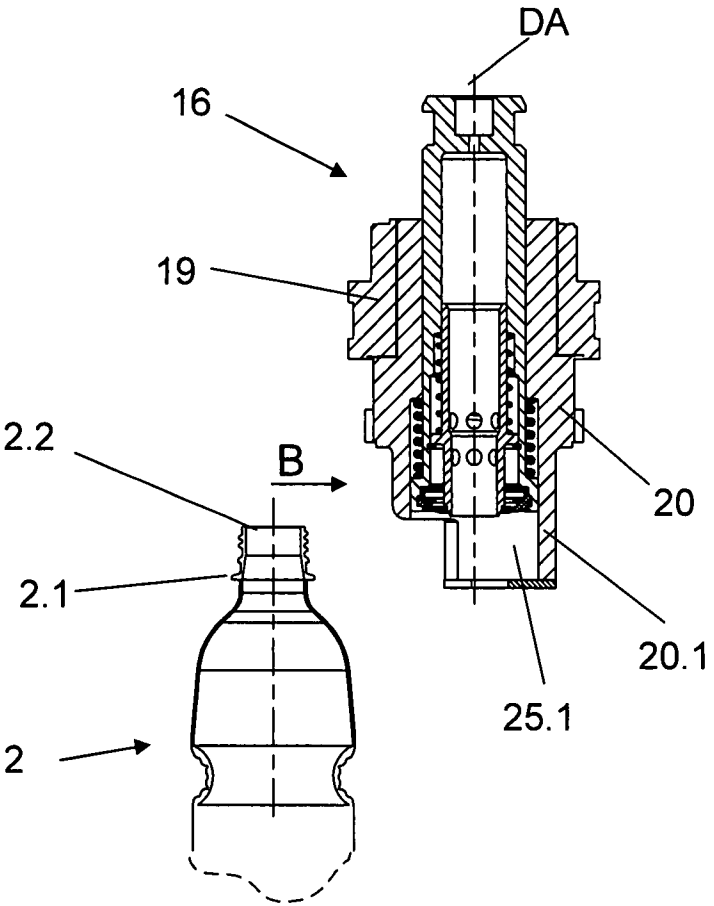
Figure 11:
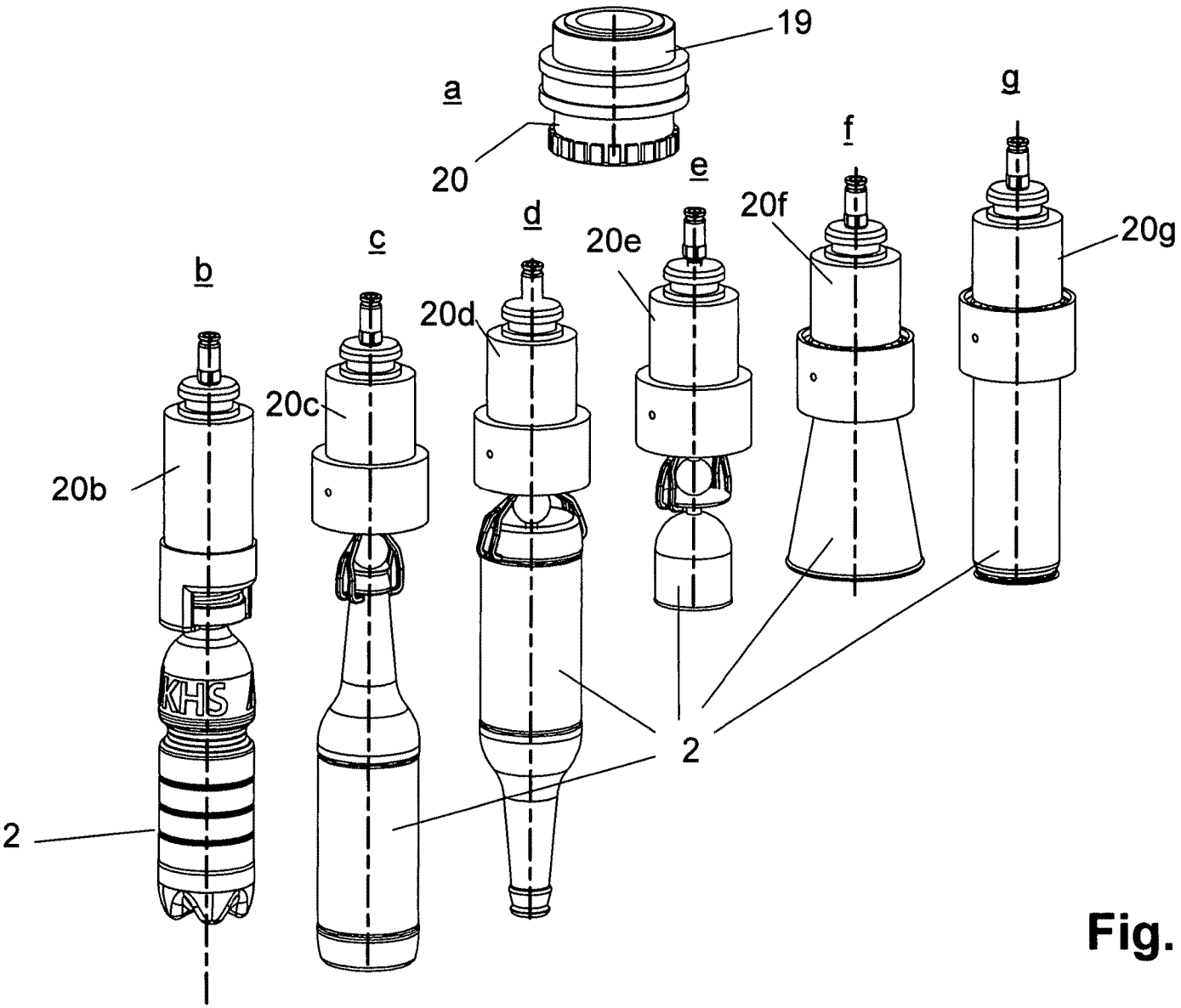
FIG. 11 shows, in position (a), in perspective representation, a primary part of a holding and centering unit, and, in positions (b)-(g), different secondary units that can be combined with the primary part of a holding-and-centering unit.

In the process, the package 2 is centered with the centering sleeve 31 or with its lower outwardly tapered end in such a way that the package axis is then arranged on the same axis as pressure segment axis DA. As shown in FIGS. 9 and 10, packages 2, which can be bottles, are printed upon while they are empty. The concentrically arranged compression springs 30 and 32 and the guides and supports that can be pushed into one another are coupled in such a way that, in step 2, a weak spring force first acts on the container mouth so that a slight movement of the package 2 on the carrier plate 26 can take place. A final holding force is applied in step 3 to achieve a gas-tight condition, as shown in FIG. 11. FIGS. 10 and 11 in turn show an alternative embodiment in which mounting-and-base part 20.1 is not detachable or is made of a single piece.

In the case of alternative embodiments (not shown) other equivalent drives are conceivable for the clamping of the packages. These equivalent drives include pneumatically or electrically driven gripping and/or clamping elements.

Figure 8:
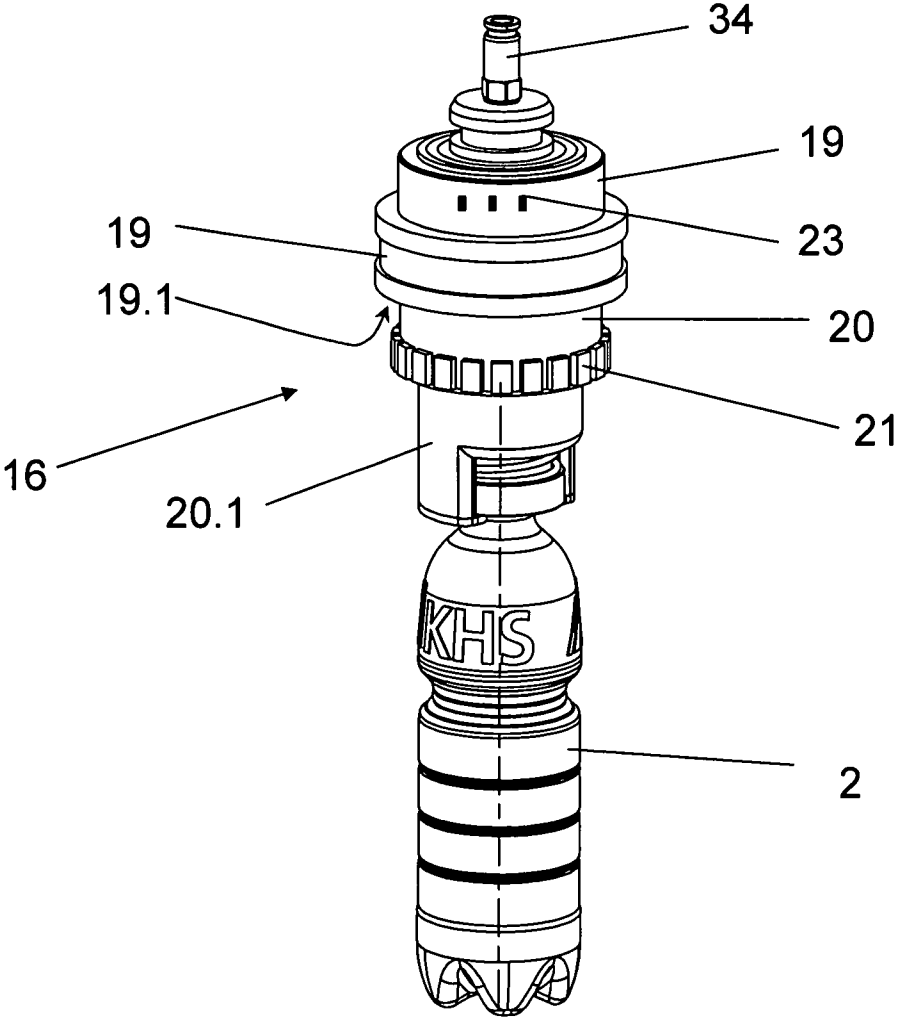

Packages 2 are picked up in a protected manner by their mouth region between mouth flange 2.1 and mouth edge 2.2 in the interior 25.1 of the sleeve 25. In particular, with a very hygienic variant, it is an advantage to configure holding-and-centering units 16 or their secondary parts 20 in such a way that the mouth 2.2 of a package 2, and nearby structures such as the mouth region and a thread located in the mouth regions, are all protected from dirt and ink spray during the printing operation In order to stabilize the still-empty packages 2, it is expedient to fill them with a pressure medium, such as a pressurized gaseous and/or vaporous medium, for example with compressed air. This filling occurs during or after the packages 2 are fixed to their respective holding-and-centering units 16. As shown in FIG. 8, a quick-acting coupling 34 for connection to a source (not shown) supplying the pressurized medium is provided for this purpose at a respective holding-and-centering unit or at its centering and holding element 28. The internal pressure in the package 2 can continue to be controlled by this quick-acting coupling 34, by a line (also not shown) in the interior of the respective holding-and-centering unit 16, and by a gas outlet. Ideally the internal pressure is held constant over the entire transport path. As can be seen from FIG. 9, holding-and-centering unit 16 is made hollow for this purpose, with the central inner cavity forming a line 29.1 through which a vaporous or gaseous medium can be passed into the interior of the package 2.

The secondary part 20 is preferentially configured in such a way that a format-dependent mounting-and-base part 20.1 is detachably connected with the secondary part 20 so that, for the processing of packages 2 of different types, shapes, and/or sizes, mounting-and-base parts 20.1 on holding-and-centering units 16 can simply be exchanged for suitably matching ones. Mounting-and-base parts 20.1 that are adapted to suit the type, shape, and/or size of packages 2 that are to be handled are then connected with the secondary part 20 in a torsion-proof manner, for example with the help of a quick-change mechanism, a quick-acting coupling, a screw fastener, and/or a clamp-fastener.

FIG. 11 again shows, in position (a), a primary part 19 of a holding-and-centering unit 16 in single view, and in positions (b)-(g), different secondary parts 20*b*-20*g* for different packages 2. These secondary parts are formed at least in part by different mounting-and-base parts 20.1. In the case of the depicted embodiments, secondary parts 20*b*-20*e* are again each executed as mechanical grippers, operable for example by compressed air, provided for holding packages 2*b*-2*c* and 2*e* by their respective package tops or in the region of their respective package openings, or for holding packages 2*d* by a package underside. Secondary parts 20f and 20*g* are executed as vacuum grippers for holding packages 2*f* and 2*g* by vacuum by their respective package tops or in the region of their respective package openings.

Holding-and-centering units 16, and preferably secondary parts 20 of these units, are in turn provided with a unique identification facility, preferably with a with an RFID code that identifies the respective holding-and-centering unit 16. The RFID code can include information about the unit's type and/or information about the particular secondary part 20. The corresponding information can then be read out by at least one reading unit of device 1 and/or of respective print module 4.1-4.*n*, for example for monitoring or inspection purposes.

Figure 12:
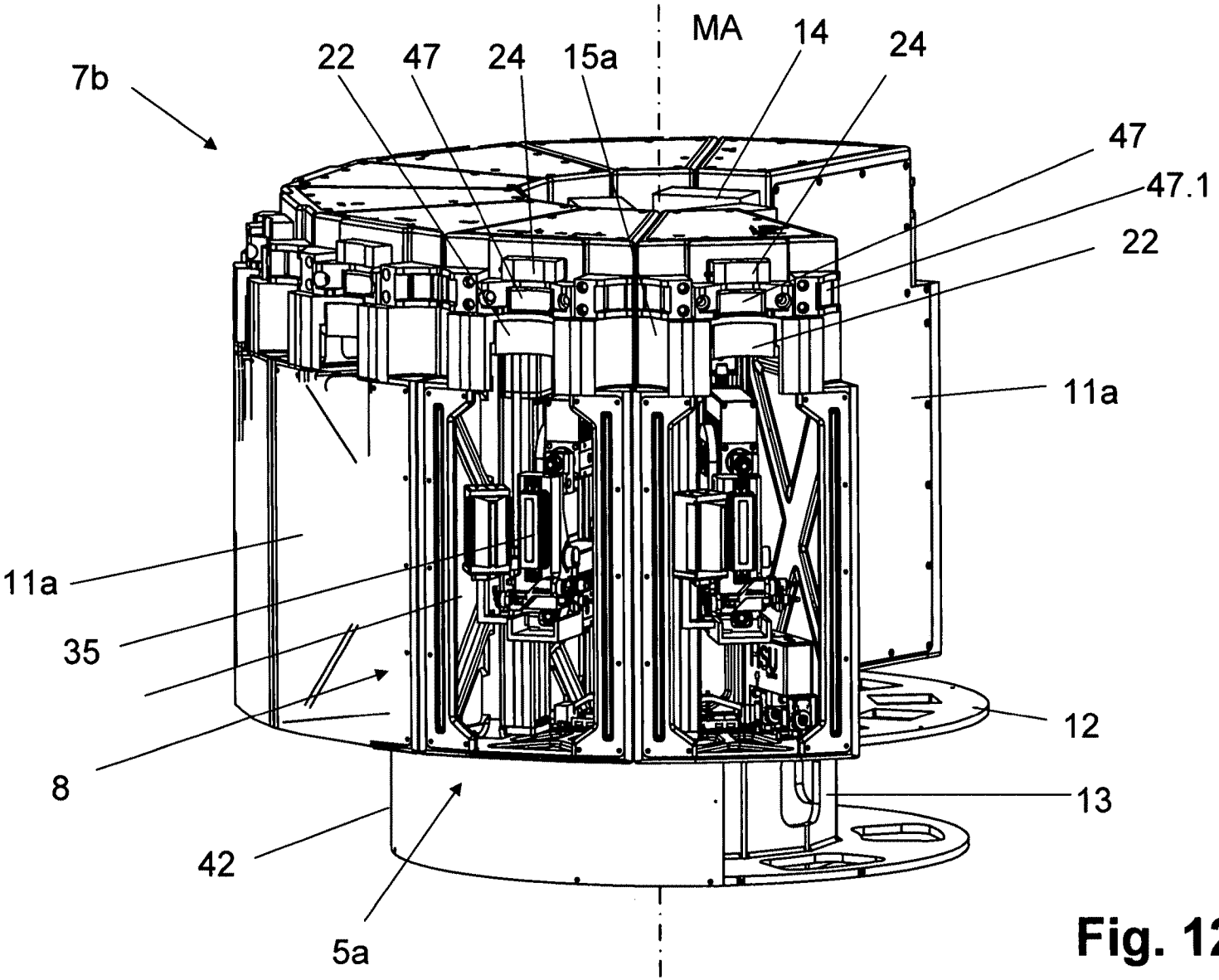
FIG. 12 shows, in perspective, a transport-and-treatment element of a further embodiment of the invention, preferably for use with the device or installation of FIG. 1.

FIG. 12 depicts a transport-and-treatment element 7*b* that can be used in the device 1 instead of transport-and-treatment elements 7. The transport-and-treatment element 7*b* differs from transport-and-treatment elements 7 essentially in that the pressure segments 11*a* that form transport-and-treatment elements 7*b* do not have the height-adjustable or displaceable carrier 17. Instead, the holding-and-centering units 16 are held directly, i.e. not height-adjustably, on respective pressure segment 11*a*. Accordingly, incremental sensor 24 and solenoid array 22 are also provided on the pressure segment 11*a* or on its housing 11*a*.1.

Pressure segments 11*a* are again provided adjacent to one another on the rotor 12, which in turn is mounted on the pillar 13 of the base unit 5*a* that corresponds to the base unit 5 so as to be rotatable and drivable about the vertical machine axis MA.

In the interior of its segmented housing 11*a*.1, each pressure segment 11*a* has the functional segments needed for printing packages 2. These include, for example, at least one inkjet print head 35 having electronically controllable discharge jets, for printing color or printing ink and other media, that are arranged in at least one row parallel to the printing-segment axis DA. A drying device 36 for the immediate drying of the printing color or corresponding printed image applied to packaging element 2 is associated with each print head 35. In the depicted embodiment, the drying device 36 is an infrared and/or UV emitter discharging a linear field of UV and/or infrared radiation 37 that covers at least the entire printed image applied with print head 35. The drying device 36 is offset by some angle against print head 35 relative to the printing-segment axis DA. During printing of a package 2, the print head is subjected to a controlled rotation about the printing-segment axis DA in such a way that the printing color applied with the print head 35 is dried or at least largely dried with the UV and/or infrared radiation 37 immediately following application.

In a way not otherwise represented, drying device 36 is cooled, for example using air and/or water as the cooling medium.

The print head 35, the drying device 36, as well as electronics 38 configured at least as a driver stage for the print head 35, are all provided on a common carriage 39 that is adjustably guided in the direction of the printing-segment axis DA on a pillar 40 by way of a positioning drive 41. In the depicted embodiment, by way of a positioning or angular drive 42 that is provided on carriage 39, print head 35 and drying device 36 can again be adjusted by pivoting, preferably by pivoting about at least one axis that is square to the printing-segment axis DA and tangential to the periphery of transport and treatment element 7*b* as formed by the pressure segments 11*a*. As a result, the position of the print head 35 can be matched to the position of the packaging element surface that is to be printed such that the jet openings of the print head 35 are as close as possible to the package's surface and so that the centerlines of the jet openings are square as possible relative to the package surface that is to be printed upon.

To avoid fouling of the pressure segment 11*a* by sprayed ink, respective print head 35 is configured with a protective element 35.1. The protective element 35 can be blade-like, scale-like and/or rubber-ball-like. During printing, the protective element 35.1 lies against the package 2 being printed upon to outwardly limit the printed space.

To configure the bundled linear infrared beam 37, the drying device 36 is executed with an optical beam forming element 36.1 in the form of a cylinder lens and with a protective and guiding aperture 36.2.

Accommodated in the interior of housing 11*a*.1 are other functional elements of the pressure segment 11. These include a pressure balancing tank 43 for the colored ink, pumps 44 for feeding ink and for removing surplus ink, as well as other functional elements that are not depicted, such as electronic control elements for the controlling of the respective pressure segment 11 and the controlling of drives 41 and 42 etc. The underside of the housing 11*a*.1 is provided with a coupling unit 45 by which all necessary electrical connections (in particular also for drives and controlling and monitoring data) and all fluid connections (for cooling functional elements and for feeding ink) can be made by plugging into a matching coupling unit (coupling panel) provided on the rotor 12.

On the narrow rear side, which lies radially inward relative to machine axis MA, mechanical holding-and-centering elements 46 are provided on the housing 11*a*.1 of each pressure segment 11*a*. With these holding-and-centering elements 46, a secure and exact connecting of the print module 11*a* with the rotor 12 or with a rotor element concentrically surrounding machine axis MA is at least partially possible by plugging in the pressure segment 11*a*.

An aperture-like wall 49 is provided on the inside of the recess or mounting 15. The aperture-like wall 49 closes off the interior space of housing 11 except for openings for the carrier 17, the print head 35 and UV and/or infrared drying unit 36.

Figure 17:
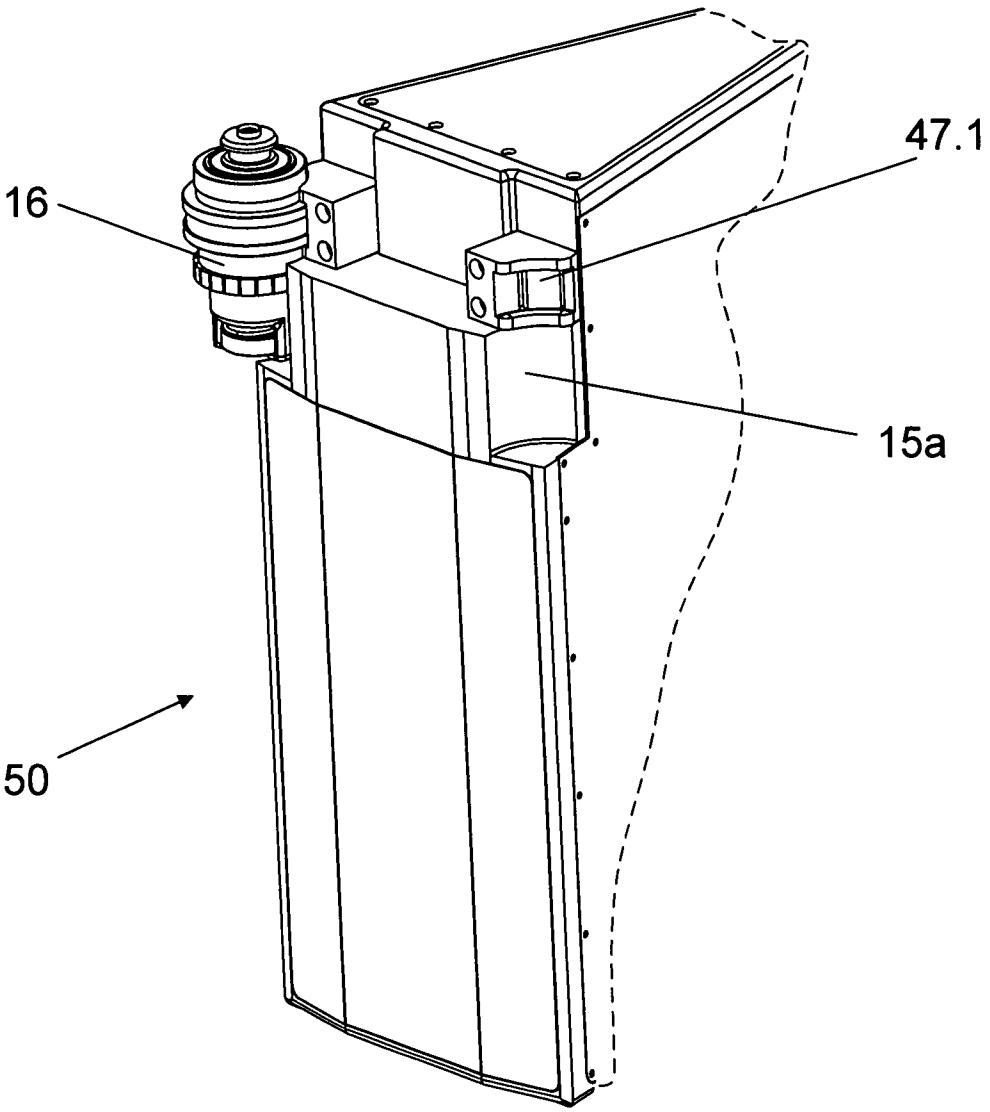
FIGS. 17 and 18 each show, in perspective, a partial view of a dummy segment for use with the device or installation of FIG. 1 or with the transport-and-treatment element of FIG. 12.

It has been assumed above that the holding-and-centering units 16 are part of individual modules 4.1-4.*n* or pressure segments 11 and 11*a*. In a preferred embodiment of the invention however, holding-and-centering units 16 are pucks that pick up respective packages 2 at the package inlet 1.1 and only release the packages 2 again at the package outlet 1.2. This means that each package 2 is held constantly on one and the same holding-and-centering unit 16 on the transport path 3 between package inlet 1.1 and the package outlet 1.2. In the course of traversing the transport path 3, the holding-and-centering unit is passed on from a transport-and-treatment element 7, 7*a*, 7*b* or from a mounting 15 located there to a transport-and-treatment element 7, 7*a*, 7*b* following in transport direction A or to a mounting 15 located there. Mechanisms for holding and releasing the holding-and-centering units 16 are provided on the carriers 17 of the pressure segments 11 or on the pressure segments 11*a* for this purpose. FIG. 17 shows one example in the form of a radially projecting holding ring that interacts with or is held by controlled solenoids 47. Other gripper-like mounting, holding and/or transfer elements can also be used.

From the package outlet 1.2, the holding-and-centering units 16 are returned on a puck transport path to the package inlet 1.1. This puck transport path, which is schematically and/or functionally suggested in FIG. 1 by the broken line 48, is constituted by autonomous transport-and-treatment elements or by transport-and-treatment elements 7. In the latter case, an additional mounting 15*a* is then provided between two recesses 15 for the mounting of a holding-and-centering unit 16 (FIGS. 4 and 12). In the case of the depicted embodiments, this is formed by corresponding concave vaults in the face of each of two pressure segments, such as pressure segments 11, 11*a* or their respective housings 11.1, 11*a*.1. These additional recesses 15*a* for the empty holding-and-centering units 16 that are to be returned are thus each formed from two part-recesses and are, in the depicted example, on the same level as the receptacles 15. Additional recesses 15*a* also exhibit holding magnets and solenoids 47.1, with a holding magnet and solenoid 47.1, also executed as a permanent magnet if necessary, being provided at least in every second, and ideally in both part-receptacles.

Figure 18:
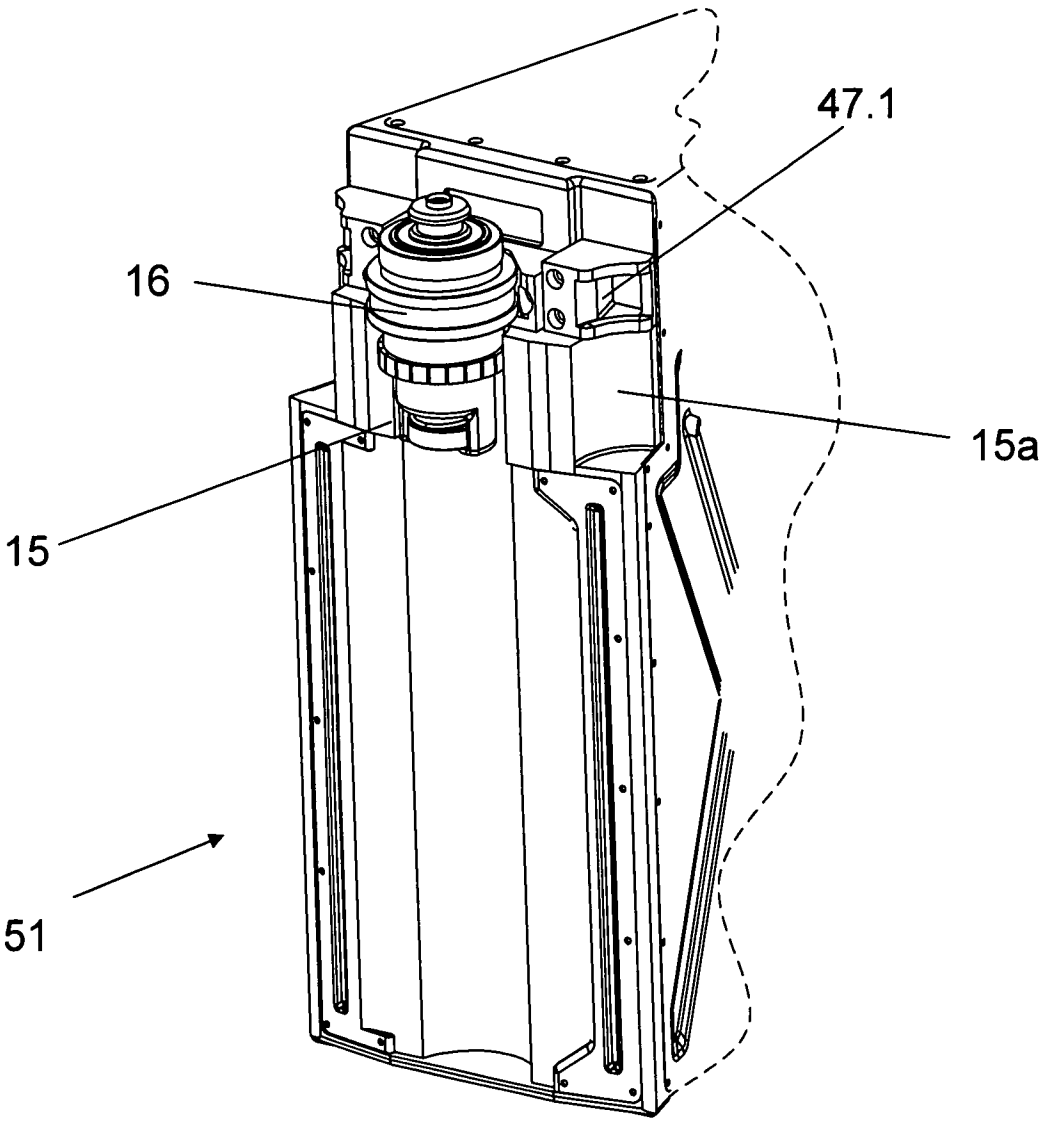

FIGS. 17 and 18 show two different dummy segments 50, 51 that match, or that have housings that match the shape, size, or dimension of the pressure segments 11*a* and that essentially differs from the pressure segments 11*a* only because they do not exhibit all of the functional elements needed for the printing of packages 2.

The dummy segments 50, 51*b* are arranged on transport and treatment elements 7*b* between pressure segments 11*a* in order to reduce the number of handling positions 8 formed by pressure segments 11*a* on transport and treatment elements 7*b* if, for example, only a reduced throughput (number of packages 2 handled per unit of time) is required for the corresponding device 1. The dummy segments 50, 51 can also be used to return holding-and-centering units 16, which are configured as pucks, from the package outlet 1.2 to the package inlet 1.1, with holding-and-centering units 16 being held either at the receptacles 15 or at regions of the dummy segments 50, 51 that correspond to receptacles 15*a*.

Figure 19:
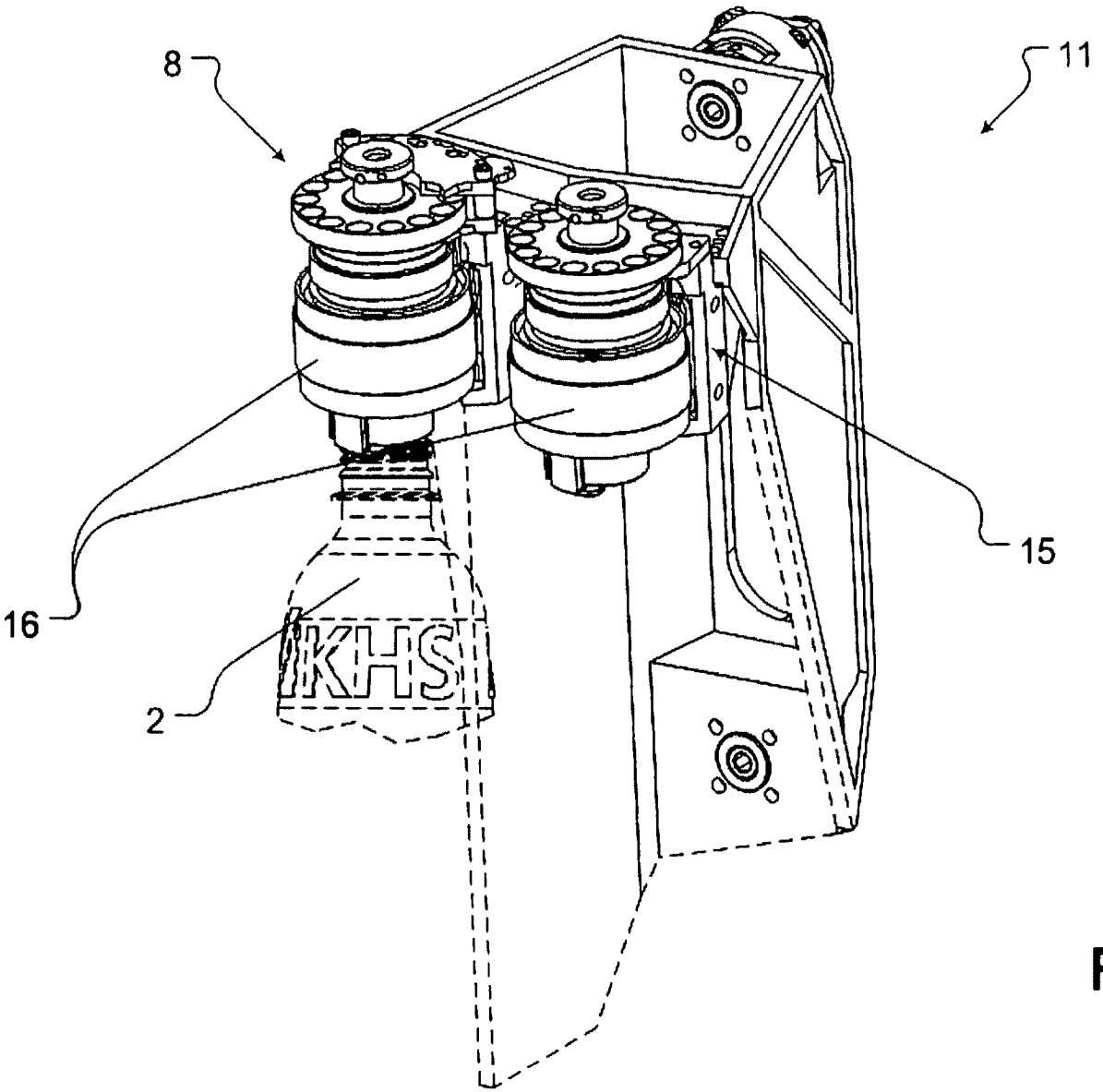
FIG. 19 shows another embodiment of a pressure segment.

FIG. 12 shows an annular tank 42 surrounding the pillar 13. The annular tank 42 receives ink of the respective printing color. It is provided, for example, on the base unit 5*a* and is connected by a rotary connection with pressure balancing tanks 43 and/or with pumps 44 located at the pressure balancing tanks 43. further embodiment of the pressure segment is shown in FIG. 19. In this case the holding position for empty holding-and-centering units 16 is not distributed over two adjacent pressure segments 11 but instead the pressure segment comprises both a mounting or treatment position 8 (the left-hand position in FIG. 19) on which container 2 can for example be printed or handled in the aforesaid manner, and a full recess 15 (right-hand position, here concealed by empty holding-and-centering units 16). This can only receive or transfer one holding-and-centering unit 16. The other functions and elements of pressure segment 11 can be provided analogously, as described above in conjunction with the other figures.

This applies equally to a dummy segment 50, 51 (not shown) which is constituted in the constructional form according to FIG. 19 and does not comprise any activable or functional treatment position 8. Here ideally, only the right-hand position of recess 15 is configured for receiving holding-and-centering units 16.

Among the advantages of the are that the relationship of packages 2 to the basic machine or device 1 is decoupled, i.e. in particular holding-and-centering units 16, including in their configuration as puck, can be adapted to different shapes, sizes, etc. of packages 2 and that in particular a height adjustment of carriers 17 and/or of carriages 39 carrying print heads 35 is also possible for adapting to the different shapes, sizes, and forms of packages 2.

Another advantage of the invention is that pressure segments 11 and 11*a* are configured as fully functional assembly units or modules. This means that not only is the assembly of the respective device 1 simplified, but it is also possible to replace, for example, faulty pressure segments 11 or 11*a* and to repair such printing segments 11 or 11*a* outside the device 1.

Yet another advantage is simplification of stock-keeping by the manufacturer of the device 1.

Yet another advantage is that the use of dummy segments 50 and 51 makes it possible to adapt device 1 to a reduced throughput.

Another advantage is that structurally identical base units 5 can be used with structurally identical pressure segments 11 to realize the device 1. This generally results in a compact design for the device 1.

The invention has been described hereinbefore by reference to embodiments. It goes without saying that numerous variations as well as modifications are possible, in particular including in regard to holding-and-centering units 16, pressure segments 11, 11*a* and the device as a whole, without departing from the inventive concept underlying the invention. So, for example, instead of coding 23 on the primary part 19, this coding can be provided on the part 20, or on both to then together constitute, with an incremental sensor disposed on the pressure segment 11 or 11*a*, an encoder system for the aligning and/or controlled rotating of packages 2.

The invention has also been described hereinbefore in the context of packages 2 that are bottles. The inventive device, its holding-and-centering units, and its printing segments are however also suited to the applying of a furnishing, for example of a print or multiple-pass print, also polychrome print, onto other containers or packages.

LIST OF REFERENCE CHARACTERS

1 Device
1.1 Package inlet
1.2 Package outlet
2 Packages or bottles
2.1 Mouth flange
2.2 Packages or bottles Mouth
3 Route of the packages transport section
4.1-4.*n* Module
5, 5*a* Base unit
6 Module housing
7 Transport-and-treatment element
8 Treatment position
9, 10 Section of the transport section
11, 11*a* Pressure segment
12 Rotor
13 Pillar
14 Electronics
15, 15*a* Recess
16 Holding-and-centering unit
17 Carrier or puck carrier

18 Slot
19 Primary part
19.1 Reference face
19.2 Bearing
20 Secondary part
20.1 Receiving and base part
21 Permanent magnet array
22 Solenoid array
23 Coding
24 Incremental sensor
25 Sleeve
25.1 Interior space
25.2 Thread
26 Carrier plate
27 Opening
28 Centering element
29 Sleeve body
29.1 Line
30 Compression spring
31 Centering sleeve
32 Compression spring
33 Annular slot
34 Quick-acting coupling
35 Print heads
36 Infrared device
36.1 Beam forming element
36.2 Protective and guiding aperture
37 Infrared beam
38 Electronics
39 Carriage
40 Pillar
41,42 Drive
43 Pressure balancing tank
44 Pump
45 Coupling unit
46 Mechanical holding and centering element
47 Holding magnet or solenoid
47.1 Holding magnet or solenoid in recess 15, 15*a*
48 Transport section
49 Wall
50, 51 Dummy segment
A Transport direction
B Movement of packages 2 during the connection with a holding and centering unit
DA Axis of the pressure segment 11
MA Machine axis

The invention claimed is:

1. An apparatus for treating packages by applying furnishing features to said packages, said furnishing features comprising polychrome printed images, said apparatus comprising a plurality of pressure segments, each of which is configured as a fully functional assembly unit having at least one ink-jet print head, a pressure balancing tank for storing ink, and a pump system for feeding said ink and for discharging surplus ink.

2. The apparatus of claim 1, further comprising a package inlet, a package outlet, a transport-and-treatment element that can be driven to rotate about a machine axis, wherein said transport-and-treatment element comprises a plurality of treatment positions on which packages, at least during said treatment, are handled, and a package transport section on which for the purpose of treating, packages are moved in a transport direction from said package inlet to said package outlet, wherein said package transport section is formed at least in part by said transport-and-treatment element, wherein said pressure segments are arranged interchangeably on a rotor that can be driven to rotate about said machine axis, wherein said segments are adjacent to each other, wherein each of said treatment positions comprises a pressure segment, wherein said machine axis is vertical, and wherein said packages are handled by either centering said packages or moving said packages under control.

3. The apparatus of claim 1, further comprising holding-and-centering units for handling packages, wherein each holding-and-centering unit comprises a primary part and a secondary part, wherein said primary part is held at a respective treatment position during treatment of a package, wherein said secondary part engages functional elements necessary for handling said package during treatment thereof, wherein said secondary part comprises a gripper for holding said package, and wherein handling comprises at least one of holding a package, centering a package, aligning a package, moving a package, rotating a package, and pivoting a package at a treatment position during treatment thereof.

4. The apparatus of claim 1, wherein said print head is adjustable by movement in a direction along said machine axis.

5. The apparatus of claim 1, wherein said pressure segment comprises a solenoid array that forms a stator of a rotary drive for a holding-and-centering unit that holds a package, and an incremental sensor for scanning a coding of a holding and centering unit, and a holder for controlled holding and releasing of a package.

6. The apparatus of claim 1, wherein said segments are adjacent to one another and wherein said segments enclose a space.

7. The apparatus of claim 1, wherein each of said segments has a recess on a radially-facing side thereof.

8. The apparatus of claim 1, wherein said plurality of segments comprises a segment that lacks an ink-jet print head and that does not treat a container, whereby throughput of said apparatus is reduced from what said throughput would be if said segment that does not treat a container were configured to treat a container.

9. An apparatus for treating packages by applying furnishing features to said packages, said furnishing features comprising polychrome printed images, said apparatus comprising a plurality of pressure segments, each of which is configured as a fully functional assembly unit having at least one ink-jet print head and a coupling unit for establishing an electrical connection and a fluid connection between said pressure segment and a coupling unit on a rotor.

10. The apparatus of claim 9, further comprising a package inlet, a package outlet, a transport-and-treatment element that can be driven to rotate about a machine axis, wherein said transport-and-treatment element comprises a plurality of treatment positions on which packages, at least during said treatment, are handled, and a package transport section on which for the purpose of treating, packages are moved in a transport direction from said package inlet to said package outlet, wherein said package transport section is formed at least in part by said transport-and-treatment element, wherein said pressure segments are arranged interchangeably on a rotor that can be driven to rotate about said machine axis, wherein said segments are adjacent to each other, wherein each of said treatment positions comprises a pressure segment, wherein said machine axis is vertical, and wherein handling comprises at least one of centered and moved under control.

11. The apparatus of claim 9, further comprising dummy segments disposed between pressure segments, wherein said dummy segments match said pressure segments in shape and size, wherein said dummy segments do not constitute a treatment position.

12. The apparatus of claim 9, further comprising holding-and-centering units for handling packages, wherein each holding-and-centering unit comprises a primary part and a secondary part, wherein said primary part is held at a respective treatment position during treatment of a package, wherein said secondary part engages functional elements necessary for handling said package during treatment thereof, wherein said secondary part comprises a gripper for holding said package, and wherein handling comprises at least one of holding a package, centering a package, aligning a package, moving a package, rotating a package, and pivoting a package at a treatment position during treatment thereof.

13. The apparatus of claim 9, further comprising a coupling unit for establishing an electrical connection and a fluid connection between said pressure segment and a coupling unit on a rotor.

14. The apparatus of claim 9, wherein said pressure segment comprises a solenoid array that forms a stator of a rotary drive for a holding-and-centering unit that holds a package, and an incremental sensor for scanning a coding of a holding and centering unit, and a holder for controlled holding and releasing of a package.

15. The apparatus of claim 9, wherein said print head is pivotable relative to said machine axis.

16. The apparatus of claim 9, wherein said segments are adjacent to one another and wherein said segments enclose a space.

17. The apparatus of claim 9, wherein each of said segments has a recess on a radially-facing side thereof.

18. An apparatus for treating packages by applying furnishing features to said packages, said furnishing features comprising polychrome printed images, said apparatus comprising a plurality of pressure segments, each of which is configured as a fully functional assembly unit having at least one ink-jet print head, wherein said segments are adjacent to one another and wherein said segments are configured as wedges when seen in plan view.

19. The apparatus of claim 18, further comprising a package inlet, a package outlet, a transport-and-treatment element that can be driven to rotate about a machine axis, wherein said transport-and-treatment element comprises a plurality of treatment positions on which packages, at least during said treatment, are handled, and a package transport section on which for the purpose of treating, packages are moved in a transport direction from said package inlet to said package outlet, wherein said package transport section is formed at least in part by said transport-and-treatment element, wherein said pressure segments are arranged interchangeably on a rotor that can be driven to rotate about said machine axis, wherein said segments are adjacent to each other, wherein each of said treatment positions comprises a pressure segment, wherein said machine axis is vertical, and wherein said packages are handled by either centering said packages or moving said packages under control.

20. The apparatus of claim 18, wherein each pressure segment comprises mechanical centering-and-holding elements on said pressure segment.

21. The apparatus of claim 18, further comprising a coupling unit for establishing an electrical connection and a fluid connection between said pressure segment and a coupling unit on a rotor.

22. The apparatus of claim 18, further comprising holding-and-centering units for handling packages, wherein each holding-and-centering unit comprises a primary part and a secondary part, wherein said primary part is held at a respective treatment position during treatment of a package, wherein said secondary part engages functional elements necessary for handling said package during treatment thereof, wherein said secondary part comprises a gripper for holding said package, and wherein handling comprises at least one of holding a package, centering a package, aligning a package, moving a package, rotating a package, and pivoting a package at a treatment position during treatment thereof.

23. The apparatus of claim 18, wherein said pressure segment comprises a solenoid array that forms a stator of a rotary drive for a holding-and-centering unit that holds a package, and an incremental sensor for scanning a coding of a holding and centering unit, and a holder for controlled holding and releasing of a package.

24. The apparatus of claim 18, wherein said segments are adjacent to one another and wherein said segments enclose a space.

25. The apparatus of claim 18, wherein each of said segments has a recess on a radially-facing side thereof.

26. An apparatus for treating packages by applying furnishing features to said packages, said furnishing features comprising printed images, wherein said printed images comprise at least a first color and a second color, said apparatus comprising a plurality of segments, at least some of which are configured as fully functional modules having at least one ink-jet print head, wherein each of said modules comprises first and second mechanical holding-and-centering elements on an outside of a housing of said segment, wherein, as a result of said first and second mechanical holding-and-centering elements, a secure connection is made between said module and a rotor is formed when said module is plugged into said rotor.

27. The apparatus of claim 26, wherein each of said ink-jet print heads prints at most one color.

* * * * *